US010242657B2

(12) United States Patent
Stickney et al.

(10) Patent No.: US 10,242,657 B2
(45) Date of Patent: Mar. 26, 2019

(54) SNORING ACTIVE NOISE-CANCELLATION, MASKING, AND SUPPRESSION

(71) Applicant: SNOREHAMMER, INC., Mercer Island, WA (US)

(72) Inventors: Kathleen Marie O'Leary Stickney, Mercer Island, WA (US); Mark A. Haun, Brier, WA (US); Mark Samuel Freeman, Redmond, WA (US)

(73) Assignee: SNOREHAMMER, INC., Mercer Island, WA (US)

( * ) Notice: Subject to any disclaimer, the term of this patent is extended or adjusted under 35 U.S.C. 154(b) by 27 days.

(21) Appl. No.: 15/469,231

(22) Filed: Mar. 24, 2017

(65) Prior Publication Data

US 2017/0323630 A1 Nov. 9, 2017

Related U.S. Application Data

(60) Provisional application No. 62/333,619, filed on May 9, 2016.

(51) Int. Cl.
*G10K 11/178* (2006.01)

(52) U.S. Cl.
CPC ..... *G10K 11/178* (2013.01); *G10K 11/17857* (2018.01); *G10K 11/17881* (2018.01); (Continued)

(58) Field of Classification Search
CPC ..... G10K 2210/1081; G10K 2210/1281–2210/1283; G10K 2210/128
(Continued)

(56) References Cited

U.S. PATENT DOCUMENTS 5,740,258 A * 4/1998 Goodwin-Johansson ..... G10K 11/178 381/72

5,844,996 A 12/1998 Enzmann et al.

(Continued)

FOREIGN PATENT DOCUMENTS

DE 10 2004 052 845 A1 5/2006
WO 87/05494 A1 9/1987

OTHER PUBLICATIONS

Kuo et al., "Active Noise Control: A Tutorial Review," *Proceedings of the IEEE 87*(6):943-966, 1999.

(Continued)

*Primary Examiner* — Disler Paul
(74) *Attorney, Agent, or Firm* — Cozen O'Connor

(57) ABSTRACT

A kit for attenuation of noise includes a noise source audio transducer, two ear pieces, and a control unit. The two ear pieces have respective resilient bodies that engage outer portions of ear canals of respective ears of a user while respective in-ear transducers of the two ear pieces are respectively positioned in inner portions of the ear canals. The respective in-ear transducers detect discrepancies (e.g., incomplete superpositioning) between the noise and the anti-noise. The respective in-ear transducers optionally detect respective secondary path effects in the ear canals. The noise source audio transducer detects noise generated by a noise source (e.g., snoring noise). The control unit configures an adaptive filter based at least in part on an error signal, and optionally based in part on secondary path effects. The control unit generates signals representative of anti-noise. The two ear pieces produce the anti-noise responsive to the signals. The two ear pieces produce masking noise with sound level that varies in direct correlation with sound level of the noise generated by the noise source.

25 Claims, 6 Drawing Sheets

(52) U.S. Cl.
CPC . *G10K 2210/1081* (2013.01); *G10K 2210/12* (2013.01); *G10K 2210/3026* (2013.01); *G10K 2210/3027* (2013.01); *G10K 2210/3028* (2013.01); *G10K 2210/3031* (2013.01); *G10K 2210/3048* (2013.01); *G10K 2210/3219* (2013.01); *G10K 2210/3221* (2013.01)

(58) Field of Classification Search
USPC ..... 381/71.1, 71.6, 73.1
See application file for complete search history.

(56) References Cited

U.S. PATENT DOCUMENTS 7,006,650 B1 2/2006 Wild
7,310,426 B2 * 12/2007 Shennib ..... H04R 25/60 381/322
7,512,247 B1 3/2009 Odinak et al.
8,559,649 B2 10/2013 Kurzweil et al.
8,693,717 B2 * 4/2014 Kasanmascheff ..... H04R 25/50 381/317
9,648,410 B1 * 5/2017 Kratsas ..... H04R 1/1041
2003/0235313 A1 12/2003 Kurzweil et al.
2004/0234080 A1 * 11/2004 Hernandez ..... G10K 11/178 381/71.11
2008/0304677 A1 12/2008 Abolfathi et al.
2013/0094658 A1 4/2013 Holter
2014/0044275 A1 * 2/2014 Goldstein ..... H04R 3/002 381/71.6
2014/0126738 A1 5/2014 Kurzweil et al.
2014/0185828 A1 7/2014 Helbling
2014/0270222 A1 9/2014 Hendrix et al.
2015/0190284 A1 * 7/2015 Censo ..... G10K 11/175 128/867
2016/0055842 A1 * 2/2016 DeFranks ..... A47G 9/10 381/66
2017/0041701 A1 * 2/2017 Cheng ..... H04R 1/02

OTHER PUBLICATIONS

Chakravarthy et al., "Application of Active Noise Control for Reducing Snore," IEEE Conference on Acoustics, Speech, and Signal Processing, Toulouse, France, May 14-19, 2006, 4 pages.
International Search Report and Written Opinion, dated May 15, 2017 for corresponding International Application No. PCT/US2017/024043, 12 pages.
"Bose noise-masking sleepbuds," Indiegogo, URL=https://www.indiegogo.com/projects/bose-noise-masking-sleepbuds-sleep-health, download date Nov. 21, 2017.

* cited by examiner

SNORING ACTIVE NOISE-CANCELLATION, MASKING, AND SUPPRESSION

BACKGROUND

Technical Field

This disclosure generally relates to active noise cancellation, masking, and suppression, for example, via at least one in-ear transducer in an ear canal of a user's ear.

Description of the Related Art

Active noise cancellation (ANC) is a noise control strategy using secondary, "anti-noise" sources to cancel out the primary, unwanted noise. It relies on the ability to generate acoustic waveforms having the same amplitude and opposite phase as compared to those of the primary noise, at every frequency of interest, in a "zone of quiet." Within this zone, the primary and secondary sources interfere destructively, and the noise level is reduced.

Practical systems for ANC were first developed about 30 years ago and are now widely deployed, most commonly in the cabins of aircraft, automobiles, and heavy machinery, and as headsets for the mass consumer market. These systems typically provide 10-20 dB of active attenuation, concentrated at low frequencies (up to perhaps a few hundred Hz).

A typical ANC application is road- and engine-noise suppression in a luxury car. As passengers move, both their ear locations and the acoustic reverberation environment are constantly changing. The ANC system has direct knowledge of the sound waveforms only at strategically placed microphones in the headrests or walls. At low frequencies, the wavelength in air (340 meters/second divided by the frequency in Hz) is sufficiently long that these microphone signals are a good proxy for the actual heard waveforms, but at higher frequencies, a null at the microphone could easily be a peak in sound intensity in the user's ear. In such situations the anti-noise emitted by the system would make the original noise louder. Head-worn ANC systems have a feedback microphone in, e.g., the concha of the ear. Such is still around 3 cm from the wearer's eardrum, which is about one-tenth wavelength at 1000 Hz.

BRIEF SUMMARY

Every night millions of people suffer from a restless sleep as a result of loud and/or disruptive snoring from a sleeping partner. Existing ANC solutions are unsuitable for the unique situation of snoring attenuation.

Testing with commercially available headsets and earbuds highlights the limitations of existing products.

Snoring noise harmonics extend much higher in frequency than existing ANC headsets are able to cancel. Listening tests with high-pass-filtered snore recordings demonstrate that good cancellation extending to 1 or 2 kHz is important, but the performance limitations of ANC restrict existing products to low-frequency scenarios like aircraft engine noise.

Consumer ANC systems are often used for listening to music, so they must be designed for acceptable sound reproduction. This is at odds with passive sound attenuation. For example, at all but the lowest frequencies, the noise reduction offered by a set of Bose® ANC earbuds can be achieved more simply with good-fitting foam earplugs.

The subject matter of the present application exhibits excellent performance at frequencies below about 2 kHz. In listening tests, the noise reduction on recorded snores is much better than with the tested commercial products.

Passive attenuation increases with frequency. This tends to complement ANC, whose performance usually decreases with frequency. The subject matter explained below demonstrates excellent ANC performance with an earpiece having one or more sizes or dimensions that resemble an in-ear earplug.

The phenomenon of being kept awake by noise involves psychology as well as physics. Loudness obviously plays a role, but some types of sounds are easier for the brain to tune out than others. Other sounds can be so distracting that, depending on the hearer's sensitization, they may prevent sleep even at very quiet levels. User-selectable "white sounds" like ocean surf or rainfall have an ability to mask unwanted sounds and help people fall asleep.

In a snoring-noise-reduction system, white sound can be used in at least three ways.

1. White sound can mask whatever snoring sounds remain after passive attenuation and active cancellation.

2. Because snoring is often periodic, with quiet intervals, the below explained subject matter can analyze this pattern in real time and adjust the peaks of a masking sound for greatest effect at the lowest average volume. For example, the breaking of an ocean wave would be timed to coincide with the loudest few seconds of a snore (i.e., "smart masking").

3. Injected noise permits a continuous adaptation of a secondary-path model, a transfer function between an earpiece driver output and error microphone input. This makes the below explained subject matter more robust to changes in the secondary path, e.g., if an earpiece shifts in an ear while being worn.

To provide a user with the most comprehensive snoring-attenuation solution, the below explained subject matter may leverage all three routes discussed: active noise cancellation superior to all existing products in the spectral range of snoring, excellent passive attenuation, and user-configurable masking techniques.

The wireless requirements depend on the location of the digital signal processing. If the earpieces can run the DSP algorithms locally, only a one-way link from a bedside to the earpieces is needed to carry a reference signal. Otherwise, two-way communication may be required with the earpieces to carry the error microphone signals to a processor and receive the anti-noise signal from the processor.

A kit for attenuation of noise may be summarized as including a noise source audio transducer, the noise source audio transducer positionable in use proximate a source of noise; a first ear piece wearable at least partially in an ear canal of a first ear of a user who is not the source of noise, the first ear piece including at least one resilient body, at least one in-ear audio transducer, and at least one radio, the at least one resilient body sized and dimensioned to resiliently engage an outer portion of the ear canal, the at least one in-ear audio transducer spaced to be positioned in an inner portion of the ear canal when the at least one resilient body resiliently engages the outer portion of the ear canal, the at least one radio communicatively coupled to provide drive signals to drive the at least one in-ear audio transducer to produce anti-noise and to transmit error signals representative of a discrepancy between the noise and the anti-noise in the ear canal of the first ear detected by the at least one in-ear audio transducer; a second ear piece wearable at least partially in an ear canal of a second ear of the user, the second ear piece including at least one resilient body, at least one in-ear audio transducer, and at least one radio, the at least one resilient body sized and dimensioned to resiliently engage an outer portion of the ear canal, the at least one in-ear audio transducer spaced to be positioned in an inner portion of the ear canal when the at least one resilient body resiliently engages the outer portion of the ear canal, the at least one radio communicatively coupled to provide drive signals to drive the at least one in-ear audio transducer to produce anti-noise and to transmit error signals representative of a discrepancy between the noise and the anti-noise in the ear canal of the second ear detected by the at least one in-ear audio transducer; and a control unit including at least one radio and at least one antenna, the at least one radio and the at least one antenna communicatively coupleable to: i) the noise source audio transducer to receive signals representative of noise generated by the noise source, ii) the at least one radio of the first ear piece to receive error signals representative of the discrepancy between the noise and the anti-noise in the ear canal of the first ear and to provide signals representative of an anti-noise to be generated by the at least one in-ear audio transducer of the first ear piece, and iii) the at least one radio of the second ear piece to receive error signals representative of the discrepancy between the noise and the anti-noise in the ear canal of the second ear and to provide signals representative of an anti-noise to be generated by the at least one in-ear audio transducer of the second ear piece.

The kit may further include a noise source transmitter communicatively coupled to the noise source audio transducer, and operable, in use, to transmit noise signals representative of noise created by the noise source to the control unit. The noise source transmitter may be one of a low latency radio or optical transmitter.

The kit may further include a tether that communicatively couples the noise source audio transducer with the control unit. The at least one in-ear transducer of the first ear piece may include a first in-ear transducer that produces the error signals representative of the discrepancy between the noise and the anti-noise in the ear canal and a second in-ear transducer responsive to anti-noise drive signals to produce anti-noise. The at least one in-ear transducer of the first ear piece may include a single in-ear transducer that produces the error signals representative of the discrepancy between the noise and the anti-noise in the ear canal of the first ear in the ear canal and is responsive to anti-noise drive signals to produce anti-noise. The control unit may include circuitry including at least one digital signal processor that generates signals representative of an anti-noise to be generated by the at least one in-ear audio transducer of the first or the second ear pieces to perform active noise cancellation, wherein the at least one digital signal processor may generate signals representative of the anti-noise to be generated based at least in part on signals representative of noise generated by the noise source and the error signals. The at least one radio of the first ear piece may be communicatively coupled to receive secondary path characterizing signals representative of secondary path effects in the ear canal of the first ear detected by the at least one in-ear audio transducer and to transmit the secondary path characterizing signals to the radio of the control unit and the at least one radio of the second ear piece may be communicatively coupled to receive secondary path characterizing signals representative of secondary path effects in the ear canal of the second ear detected by the at least one in-ear audio transducer and to transmit the secondary path characterizing signals to the radio of the control unit.

The at least one digital signal processor may generate signals representative of the anti-noise to be generated further based at least in part on the signals representative of the secondary path effects associated with at least one of the first or the second ear pieces. The signals representative of noise generated by the noise source may be signals representative of snoring and the at least one digital signal processor may generate signals representative of the anti-noise to be generated based at least in part on the signals representative of snoring. The circuitry of the control unit may employ at least one adaptive filter to generate the signals representative of the anti-noise. The circuitry of the control unit may configure at least one adaptive filter based on signals representative of secondary path effect in the ear canal of at least one of the ears. The circuitry of the control unit may configure at least one adaptive filter during a run time while active noise cancellation is performed. The circuitry of the control unit may provide a defined reference noise signal to at least one in-ear audio transducer of the first or the second ear pieces to produce a defined reference noise, and may sample a secondary path effect in the ear canal that results from the defined reference noise. The circuitry of the control unit may provide the defined reference noise signal during a training period during which no active noise cancellation is performed. The circuitry of the control unit may provide a masking noise signal to at least one in-ear audio transducer of the first or the second ear pieces to produce a masking noise while active noise cancellation is performed. The circuitry of the control unit may adjust sound level of the masking noise in synchronization with a sound level of the noise generated by the noise source. The circuitry of the control unit may adjust sound level of the masking noise in direct correlation with a sound level of the noise generated by the noise source. The control unit may be separate and distinct from the first and the second ear pieces, and remotely spaced from the first and the second ear pieces in use. The control unit may be an integral part of one of the first or the second ear pieces.

The first ear piece may further include a first housing and the at least one resilient body may include a first resilient body and at least a second resilient body, the second resilient body having a different dimension than the first resilient body, the first and the second resilient bodies interchangeably over at least a portion of the first housing.

The kit may further include a set of instructions which includes at least one instruction to locate the noise source audio transducer closer to the source of noise than the user by a defined distance. The defined distance may be less than 2-3 feet.

A method of attenuation of snoring noise may be summarized as including receiving a number of noise source signals by circuitry from a noise source audio transducer positioned proximate a source of snoring noise, the noise source signals representative of snoring produced by the source of the snoring noise; receiving a number of error signals by the circuitry, the error signals representative of at least one discrepancy between the noise and the anti-noise in a first ear canal of a user who is not the noise source, the at least one discrepancy between the noise and the anti-noise detected by at least one in-ear audio transducer; generating a number of anti-noise drive signals by the circuitry to produce anti-noise, the generation of the anti-noise drive signals based at least in part on the received noise source signals and the received error signals; and providing the anti-noise drive signals by the circuitry to at least one in-ear audio transducer to produce anti-noise in at least one ear canal. Receiving a number of error signals may include receiving a first number of error signals from a first in-ear transducer, the first number of error signals representative of at least one discrepancy between the noise and the anti-noise in a first ear canal of the user and contemporaneously receiving a second number of error signals from a second in-ear transducer, the second number of error signals representative of at least one discrepancy between the noise and the anti-noise in a second ear canal of the user, the second ear canal different from the first ear canal.

The method may further include configuring at least one adaptive filter by the circuitry based on error signals representative of discrepancy between the noise and the anti-noise that occurs in at least one ear canal.

The method may further include providing a defined reference noise signal by the circuitry to at least one in-ear audio transducer to produce a defined reference noise in at least one ear canal; detecting, by at least one in-ear audio transducer, at least one secondary path effect in the at least one ear canal of the user; and configuring at least one adaptive filter based on signals representative of secondary path effect that occurs in the at least one ear canal as a result of the defined reference noise. Providing a defined reference noise signal by the circuitry to at least one in-ear audio transducer may include providing a defined reference noise signal that produces a white noise. Providing a defined reference noise signal by the circuitry to at least one in-ear audio transducer may include providing a defined reference noise signal during a period during which no active noise cancellation is performed.

The method may further include providing a masking noise signal to at least one in-ear audio transducer by the circuitry to produce a masking noise while active noise cancellation is performed. Providing a masking noise signal may include adjusting a sound level of the masking noise in synchronization with a sound level of the noise generated by the source of the snoring noise. Adjusting a sound level of the masking noise in synchronization with a sound level of the noise generated by the noise source may include adjusting sound level of the masking noise in direct correlation with the sound level of the noise generated by the source of the snoring noise.

The method may further include forming a noise damping seal between an ambient environment and an inner portion of at least one ear canal with at least one resilient member.

A method of snoring noise attenuation may be summarized as including receiving a number of noise source signals by circuitry from a noise source audio transducer positioned proximate a source of snoring noise, the noise source signals representative of snoring produced by the source of the snoring noise; generating a number of noise masking drive signals by the circuitry to produce noise masking sound in synchronization with a sound level of the noise generated by the source of the snoring noise, the generation of the noise masking drive signals based at least in part on the received noise source signals; and providing the noise masking drive signals by the circuitry to at least one in-ear audio transducer to produce the noise masking sound in at least one ear canal. Generating a number of noise masking drive signals may include generating the noise masking drive signals to adjusts sound level of the masking noise in direct correlation with a sound level of noise generated by a source of the snoring noise.

The method may further include receiving a number of error signals by the circuitry, the error signals representative of a discrepancy between the noise and the anti-noise that occurs in at least one ear canal, the discrepancy between the noise and the anti-noise detected by at least one in-ear audio transducer; generating a number of anti-noise drive signals by the circuitry to produce anti-noise, the generation of the anti-noise drive signals based at least in part on the received noise source signals and the received error signals; and providing the anti-noise drive signals by the circuitry to at least one in-ear audio transducer to produce anti-noise in at least one ear canal.

An ear piece wearable by a user may be summarized as including a resilient body, the resilient body sized and dimensioned to resiliently engage an outer portion of an ear canal of an ear of a human user when worn at least partially in the ear canal; at least one in-ear audio transducer, the at least one in-ear audio transducer spaced to be positioned in an inner portion of the ear canal when the at least one resilient body resiliently engages the outer portion of the ear canal; and at least one radio, the at least one radio communicatively coupled to provide drive signals to drive the at least one in-ear audio transducer to produce anti-noise and to transmit error signals representative of at least one discrepancy between the noise and the anti-noise detected in the ear canal by the at least one in-ear audio transducer. The at least one in-ear transducer of the ear piece may include a first in-ear transducer that produces error signals representative of the first discrepancy between the noise and the anti-noise in the ear canal and a second in-ear transducer responsive to anti-noise drive signals to produce anti-noise. The at least one in-ear transducer of the first ear piece may include a single in-ear transducer that produces error signals representative of the discrepancy between the noise and the anti-noise in the ear canal and is responsive to anti-noise drive signals to produce anti-noise.

The ear piece may further include control circuitry that generates signals representative of the anti-noise to be generated based at least in part on the signals representative of snoring, wherein the control circuitry is an integral part of ear piece. The control circuitry may include at least one digital signal processor that implements at least one adaptive filter. The at least one adaptive filter may adapt based at least in part on the error signals. The resilient body may be selectively replaceable from the ear piece.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn, are not necessarily intended to convey any information regarding the actual shape of the particular elements, and may have been solely selected for ease of recognition in the drawings.

DETAILED DESCRIPTION

The present disclosure includes certain specific details to provide a thorough understanding of various disclosed implementations. The present disclosure makes clear to one of skill in the relevant art that practice of one or more implementations may include or omit one or more of such specific details or may replace or modify such specific details with other elements, features, functions, or method acts. In other instances, to avoid unnecessarily obscuring disclosure of the implementations, the present disclosure omits one or more express explanations or express inclusions of certain specific details where the present disclosure makes clear to one of skill in the art that practice of one or more implementations may include or omit one or more of such specific details or may replace or modify such specific details with other elements, features, functions, or method acts (e.g., the present disclosure omits well-known structures that one of skill in the relevant art associates with, for example, active noise cancellation, masking, or suppressing such as mathematical details, sound properties, physics details, housing design details, housing construction details, etc.). In one or more instances, to avoid unnecessarily obscuring disclosure of the implementations, the present disclosure omits one or more express explanations or express inclusions of one or more advantageous elements, features, functions, or method acts that the present disclosure makes clear to one of skill in the relevant art.

Unless context requires otherwise, throughout the specification and claims that follow, the word "comprising" is synonymous with "including" and is inclusive or open-ended (i.e., does not exclude additional, unrecited elements, features, functions, or method acts).

The headings and Abstract of the Disclosure provided herein are for convenience only and do not interpret the scope or meaning of the implementations.

Figure 1:
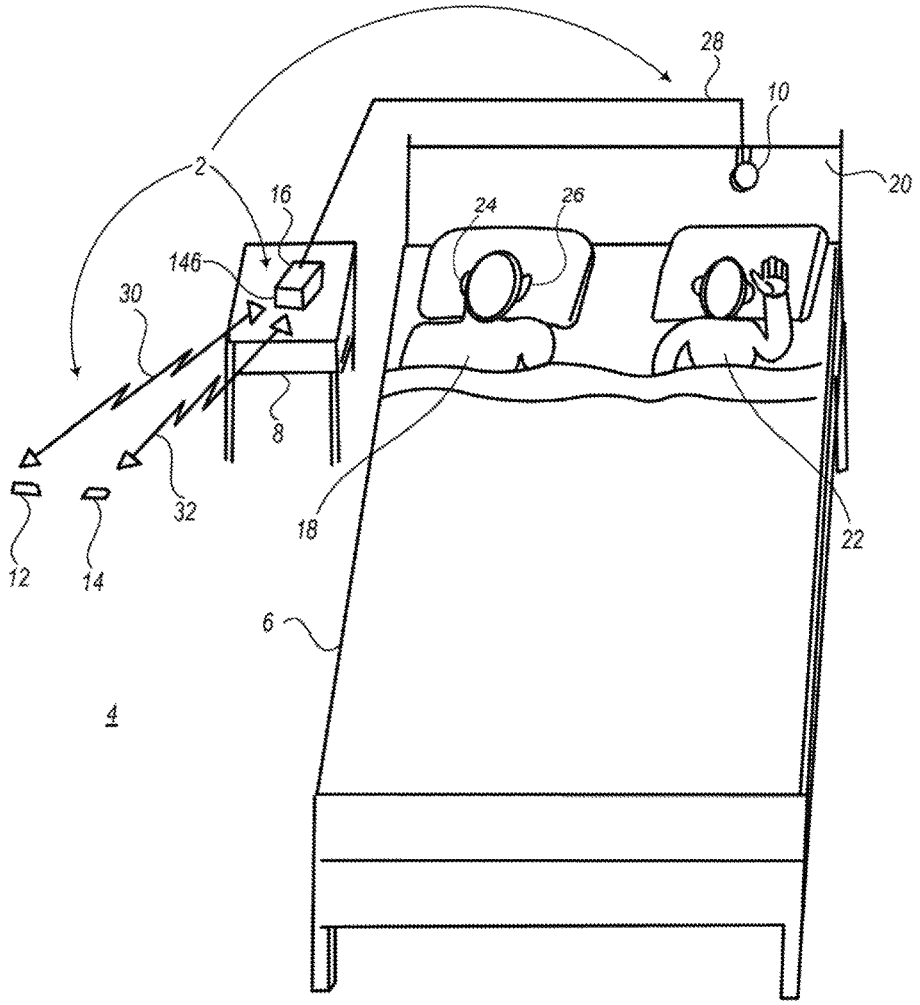
FIG. 1 is an isometric view of a kit for attenuation of noise according to at least one illustrated implementation, along with a bedroom that contains a bed and a nightstand, the kit for attenuation of noise including a noise source audio transducer, two ear pieces wearable at least partially in ear canals of respective ears of a user, and a control unit communicatively coupleable to the noise source audio transducer and communicatively coupleable to respective radios of the two ear pieces.

FIG. 1 shows a kit 2 for attenuation of noise according to at least one illustrated implementation, along with a bedroom 4 that contains a bed 6 and a nightstand 8. The kit 2 for attenuation of noise may include at least one noise source audio transducer 10, at least one first ear piece 12, at least one second ear piece 14, and at least one control unit 16.

The noise source audio transducer 10 may be positionable, in use, proximate a source of noise (e.g., one or more microphones proximate the source of noise). The kit 2 for attenuation of noise may include a set of instructions. The set of instructions may include at least one instruction to position the noise source audio transducer 10 within a defined distance of a noise source. The defined distance may vary based at least in part on a distance between a closer one of the first ear piece 12 or the second ear piece 14 and the noise source while such are worn in use by a user 18. The defined distance may be at least two to three feet less than a distance between the closer one of the first ear piece 12 or the second ear piece 14 and the noise source while such are worn in use by the user 18. For example, FIG. 1 shows the noise source audio transducer 10 mounted on a frame 20 of the bed 6 while a person 22 that is a source of noise and the user 18 are located at respective locations in the bed 6. Alternatively, the person 22 may wear the noise source audio transducer 10. The person 22 may snore or otherwise produce a snoring noise. The noise source audio transducer 10 may be positioned within two to three feet of the person 22 who snores while the closer one of the first ear piece 12 or the second ear piece 14 is located four to six feet from the person 22 who snores while such are worn in use by the user 18 (FIG. 1 shows the first ear piece 12 and the second ear piece 14 in free space for convenience of understanding by the reader).

The first ear piece 12 may be wearable in use at least partially in an ear canal of a first ear 24 of the user 18. The second ear piece 14 may be wearable in use at least partially in an ear canal of a second ear 26 of the user 18.

The control unit 16 may communicatively couple to the noise source audio transducer 10, the first ear piece 12, and the second ear piece 14. The control unit 16 may be separate and distinct from the first ear piece 12 and from the second ear piece 14. The control unit 16 may be remotely spaced in use from the first ear piece 12 and from the second ear piece 14. For example, FIG. 1 shows the control unit 16 as resting on the nightstand 8. The control unit 16 may communicatively couple to the noise source audio transducer 10 via at least one tether 28 (e.g., electrically conductive wires, optical fiber). The control unit 16 may communicatively couple to the first ear piece 12 and the second ear piece 14 via respective wireless connections 30, 32.

Figure 2:
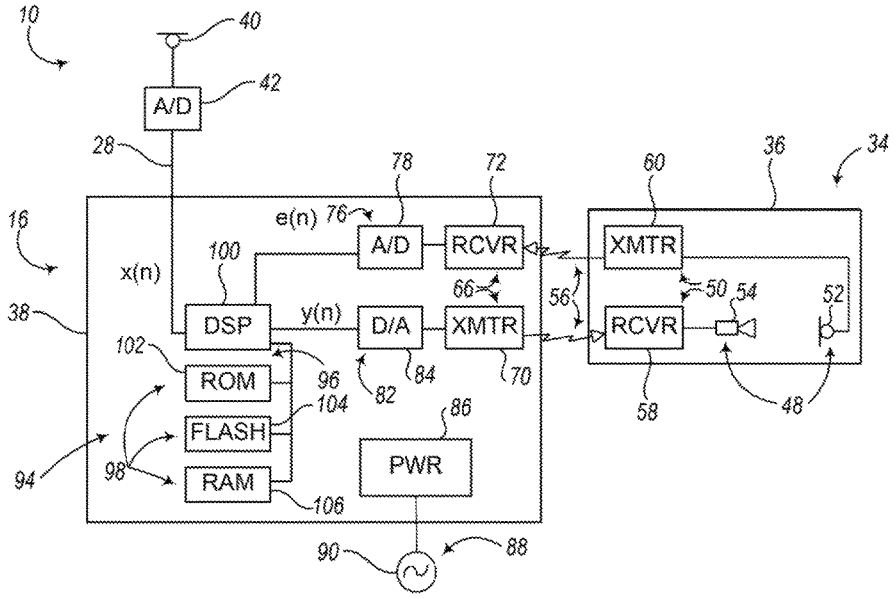
FIG. 2 is a schematic view of the kit for attenuation of noise of FIG. 1, better illustrating various internal components of the kit for attenuation of noise, including internal components of the noise source audio transducer, internal components of an example one of the two ear pieces, and internal components of the control unit, according to at least one illustrated implementation.

FIG. 2 shows various internal components of the kit 2 for attenuation of noise, including internal components of the noise source audio transducer 10, internal components of an example one 34 of the two ear pieces 12, 14, and internal components of the control unit 16. For example, the internal components may include circuitry 36 of the example ear piece 34 and circuitry 38 of the control unit 16. While typically a special purpose device, in some implementations, the control unit 16 can take the form a smartphone or tablet computer that includes at least one processor (e.g., microprocessor(s) and digital signal processor(s)) and at least one nontransitory processor-readable medium that stores at least one of processor executable instructions or data that causes the processor to perform any of the methods or algorithms described herein.

The noise source audio transducer 10 may detect noise generated by the noise source (e.g., snoring noise generated by the person 22 who snores). Responsive to detecting noise generated by the noise source, the noise source audio transducer 10 may convert the detected noise to signals representative of noise generated by the noise source. For example, FIG. 2 shows the noise source audio transducer 10 as including at least one noise source microphone 40 and at least one analog to digital converter 42. The noise source microphone 40 may produce analog electrical signals representative of noise generated by the noise source. The analog to digital converter 42 may convert the analog electrical signals representative of noise generated by the noise source. The noise source audio transducer 10 may provide signals representative of noise generated by the noise source to the control unit 16 via the tether 28 (e.g., signals x(n)).

Figure 3:
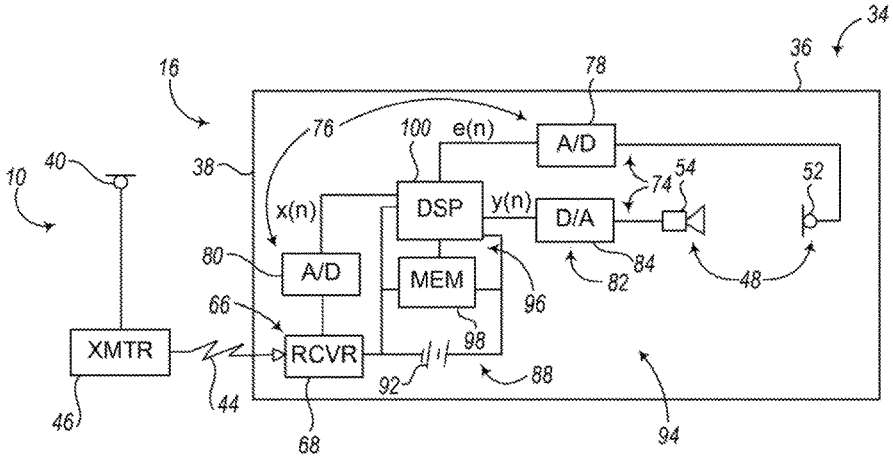
FIG. 3 is a schematic view of the kit for attenuation of noise of FIG. 1, better illustrating various internal components of the kit for attenuation of noise, including internal components of the noise source audio transducer, internal components of the example ear piece, the example ear piece including the control unit as an integral part of the example ear piece, according to at least one illustrated implementation.

Additionally or alternatively, the noise source audio transducer 10 may communicatively couple to the control unit 16 via at least one wireless connection 44 (e.g., radio, optical emitter and sensor pair such as an infrared emitter and sensor pair). For example, FIG. 3 shows the noise source audio transducer 10 as including at least one transmitter 46. The transmitter 46 may include at least one receiver or may be at least one transceiver to, for example, permit remote adjustment of one or more configuration settings of the noise source audio transducer 10. The transmitter 46 may have at least one monaural audio protocol stack. The transmitter 46 may be a low latency radio transmitter or a low latency optical transmitter (e.g., lower latency than Bluetooth®). The transmitter 46 may have a lower latency than at least one average or minimum latency of at least one of the presently known Bluetooth® codecs, protocols, profiles, stacks, or versions, including those of Bluetooth® v1.0-v4.2 such as, for example, v1.0, v1.0B, v1.1 (ratified as IEEE Standard 802.15.1-2002), v1.2 (ratified as IEEE Standard 802.15.1-2005), v2.0, v2.0+Enhanced Data Rate (EDR), v2.1, v2.1+EDR, v3.0, v3.0+High Speed (HS), v4.0, v4.1, v4.2. For example, the transmitter 46 may have a total delay of less than 45 milliseconds, 40 milliseconds, 35 milliseconds, 30 milliseconds, 25 milliseconds, 20 milliseconds, 15 milliseconds, 10 milliseconds, 5 milliseconds, 3 milliseconds, 2 milliseconds, 1 millisecond, or 500 microseconds. The transmitter 46 may operate, in use, to transmit noise signals representative of noise generated by the noise source to the control unit 16 via the wireless connection 44.

The example ear piece 34 may include at least one in-ear transducer 48 and at least one radio 50. For example, FIG. 2 shows the in-ear transducer 48 of the example ear piece 34 as including at least one first in-ear transducer 52 (e.g., at least one microphone) and at least one second in-ear transducer 54 (e.g., at least one speaker). Alternatively, the in-ear transducer 48 may be a single in-ear transducer (e.g., a combined microphone and speaker). The radio 50 may communicatively couple to the control unit 16 via a respective one 56 of the wireless connections 30, 32. For example, FIG. 2 shows the radio 50 as including at least one receiver 58 communicatively coupled to the first in-ear transducer 52 and at least one transmitter 60 communicatively coupled to the second in-ear transducer 54.

At least one of the receiver 58 or the transmitter 60 may have at least one respective monaural audio protocol stack. The receiver 58 may be a low latency radio receiver or a low latency optical receiver (e.g., lower latency than Bluetooth®). The transmitter 60 may be a low latency radio transmitter or a low latency optical transmitter (e.g., lower latency than Bluetooth®). At least one of the receiver 58 or the transmitter 60 may have a lower latency than at least one average or minimum latency of at least one of the presently known Bluetooth® codecs, protocols, profiles, stacks, or versions, including those of Bluetooth® v1.0-v4.2 such as, for example, v1.0, v1.0B, v1.1 (ratified as IEEE Standard 802.15.1-2002), v1.2 (ratified as IEEE Standard 802.15.1-2005), v2.0, v2.0+Enhanced Data Rate (EDR), v2.1, v2.1+EDR, v3.0, v3.0+High Speed (HS), v4.0, v4.1, v4.2. For example, at least one of the receiver 58 or the transmitter 60 may have a total delay of less than 45 milliseconds, 40 milliseconds, 35 milliseconds, 30 milliseconds, 25 milliseconds, 20 milliseconds, 15 milliseconds, 10 milliseconds, 5 milliseconds, 3 milliseconds, 2 milliseconds, 1 millisecond, or 500 microseconds.

Alternatively, the radio 50 may provide two-way communicative coupling to at least one of the first in-ear transducer 52 or the second in-ear transducer 54 to, for example, permit at least one of i) transmission of status reports from at least the second in-ear transducer 54 or ii) remote adjustment of one or more configuration settings of at least the first in-ear transducer 52).

The transmitter 60 may transmit error signals (e.g., signals e(n)) to the receiver 72, the error signals representative of a discrepancy between the noise and the anti-noise that is detected by at least one in-ear transducer 52. The control unit 16 employs signals representative of noise generated by the noise source and the error signals to generate an anti-noise signal, representative of an anti-noise to be produced. The anti-noise signal will typically be the inverse of the noise signal, and may be produced via one or more adaptive filters which adapts in response to the detected error, and which may thus be denominated herein as an anti-noise adaptive filter.

In some implementations, the control unit 16 account for secondary path effects. For example, during a training time and/or during a run time, the receiver 58 may receive at least one defined reference noise signal from the control unit 16 via the respective wireless connection 56. Responsive to the defined reference noise signal, the second in-ear transducer 54 may produce at least one defined reference noise in the ear canal 62 of a respective ear 64 (FIG. 8) of the user 18. At least the first in-ear transducer 52 may detect the defined reference noise or at least one reflection of the reference noise in the ear canal 62 of the respective ear 64. Responsive to detecting the defined reference noise or the reflection of the defined reference noise, at least the first in-ear transducer 52 may produce at least one signal representative of at least one secondary path effect in the ear canal 62 of the respective ear 64. The transmitter 60 may transmit signals representative of the secondary path effect in the ear canal 62 of the respective ear 64 to the control unit 16 via the respective wireless connection 56. The first in-ear transducer 52 may include at least one directional in-ear transducer.

The receiver 58 may receive at least one anti-noise drive signal (e.g., signals y(n)) from the control unit 16 via the respective wireless connection 56. Responsive to the anti-noise drive signal, at least the second in-ear transducer 54 may produce anti-noise in the ear canal 62 of the respective ear 64 to perform active noise cancellation of the noise generated by the noise source. The anti-noise signal may have amplitude that matches or substantially matches an amplitude of at least one of the noise and the noise signal that represents the noise. The anti-noise drive signal may have phase that is opposite to phase of at least one of the noise and the noise signal that represents the noise.

As noted above, at least one in-ear transducer 52 detects discrepancies between the noise and the anti-noise (i.e., incomplete superpositioning). In response, the at least one in-ear transducer 52 produces error signals e(n) which are supplied to an anti-noise adaptive filter, for example implemented by the control unit 16.

The radio 50 optionally may receive at least one masking noise signal from the control unit 16 via the respective wireless connection 56. Responsive to the masking noise signal, at least the second in-ear transducer 54 optionally may produce masking noise in the ear canal 62 of the respective ear 64 to mask the noise generated by the noise source.

The control unit 16 may include at least one radio 66 and at least one antenna (not shown). The radio 66 may communicatively couple via the antenna to the noise source audio transducer 10 via the wireless connection 44. For example, FIG. 3 shows the radio 66 as including at least one receiver 68. Alternatively, the control unit 16 may communicatively couple to the noise source audio transducer 10 via the tether 28 as explained above. The radio 66 may communicatively couple via the antenna to the radio 50 of the first ear piece 12 via the wireless connection 30 and may communicatively couple via the antenna to the radio of the second ear piece 14 via the wireless connection 32. For example, FIG. 2 shows the radio 66 as including at least one transmitter 70 communicatively coupled to the receiver 58 of the example ear piece 34 and at least one receiver 72 that communicatively coupled to the transmitter 60 of the example ear piece 34.

At least one of the receiver 68, the transmitter 70, or the receiver 72 may have at least one respective monaural audio protocol stack. At least one of the receiver 68 or the receiver 72 may be a low latency radio receiver or a low latency optical receiver (e.g., lower latency than Bluetooth®). The transmitter 70 may be a low latency radio transmitter or a low latency optical transmitter (e.g., lower latency than Bluetooth®). At least one of the receiver 68, the transmitter 70, or the receiver 72 may have a lower latency than at least one average or minimum latency of at least one of the presently known Bluetooth® codecs, protocols, profiles, stacks, or versions, including those of Bluetooth® v1.0-v4.2 such as, for example, v1.0, v1.0B, v1.1 (ratified as IEEE Standard 802.15.1-2002), v1.2 (ratified as IEEE Standard 802.15.1-2005), v2.0, v2.0+Enhanced Data Rate (EDR), v2.1, v2.1+EDR, v3.0, v3.0+High Speed (HS), v4.0, v4.1, v4.2. For example, at least one of the receiver 68, the transmitter 70, or the receiver 72 may have a total delay of less than 45 milliseconds, 40 milliseconds, 35 milliseconds, 30 milliseconds, 25 milliseconds, 20 milliseconds, 15 milliseconds, 10 milliseconds, 5 milliseconds, 3 milliseconds, 2 milliseconds, 1 millisecond, or 500 microseconds.

Additionally or alternatively, the control unit 16 may be an integral part of one of the first ear piece 12 or the second ear piece 14. For example, FIG. 3 shows the control unit 16 as an integral part of the example ear piece 34 (e.g., the circuitry 36 of the example ear piece 34 includes the circuitry 38 of the control unit 16) while the control unit 16 communicatively couples to the in-ear transducer 48 of the example ear piece 34 via a wired connection 74.

The control unit 16 may include at least one pre-processor 76. The at least one pre-processor 76 may include at least one amplifier, voltage regulator, or anti-aliasing filter. The pre-processor 76 may communicatively couple to the radio 66. For example, FIG. 2 shows the pre-processor 76 as including at least one analog to digital converter 78 communicatively coupled to the radio 66 to convert analog electrical signals that the radio 66 outputs to digital signals. Additionally or alternatively, where the control unit 16 communicatively couples to the example ear piece 34 via at least one wired connection such as the wired connection 74, the pre-processor 76 may communicatively couple to the in-ear transducer 48 of the example ear piece 34. For example, FIG. 3 shows the pre-processor 76 as including the analog to digital converter 78 communicatively coupled to the in-ear transducer 48 of the example ear piece 34 to convert analog electrical signals that the in-ear transducer 48 outputs.

Additionally or alternatively to the noise source audio transducer 10 including the analog to digital converter 42, the pre-processor 76 may communicatively couple to the noise source audio transducer 10 via the tether 28. For example, the pre-processor 76 may include the analog to digital converter 42 to convert analog electric signals that the noise source audio transducer 10 outputs. Additionally or alternatively, where the control unit 16 communicatively couples to the noise source audio transducer 10 via the wireless connection 44, the pre-processor 76 may communicatively couple to the radio 66. For example, FIG. 3 shows the pre-processor 76 as including at least one analog to digital converter 80 communicatively coupled to the radio 66 to convert analog electric signals that the radio 66 outputs.

The control unit 16 may include at least one post-processor 82. The post-processor 82 may include at least one reconstruction filter, clipper, limiter, compressor, distortion canceller, or amplifier. The post-processor 82 may communicatively couple to the radio 66. For example, FIG. 2 shows the post-processor 82 as including at least one digital to analog converter 84 communicatively coupled to the radio 66 to convert digital electrical signals that are destined for the radio 66 to analog signals. Additionally or alternatively, where the control unit 16 communicatively couples to the example ear piece 34 via at least one wired connection such as the wired connection 74, the post-processor 82 may communicatively couple to the example ear piece 34. For example, FIG. 3 shows the post-processor 82 as including the digital to analog converter 84 communicatively coupled to the in-ear transducer 48 of the example ear piece 34 to convert digital electrical signals that are destined for the in-ear transducer 48.

The control unit 16 may include at least one power supply 86 (not shown in FIG. 3). The power supply 82 may communicatively couple to one or more other components of the control unit 16 to selectively supply power to such components. The power supply 82 may communicatively couple to at least one energy source 88. The energy source 88 may include at least one external energy source 90. For example, FIG. 2 shows the external energy source 90 as including at least one alternating current energy source (e.g., at least one wall outlet). Additionally or alternatively to the energy source 88 including the external energy source 90, the energy source 88 may include at least one power storage 92. For example, FIG. 3 shows the power storage 92 as including at least one battery (e.g., at least one rechargeable or non-rechargeable lithium or lithium-ion battery).

The control unit 16 may include at least one controller 94. The controller 94 may be an embedded system or may include at least one embedded system. The controller 94 may include at least one processor 96 and at least one non-transitory memory 98. The processor 96 may include at least one portion or an entirety of the memory 98. The processor 96 may be an embedded processor. For example, FIGS. 2 and 3 show the controller 94 as including at least one digital signal processor (DSP) 100. The DSP 100 may be an embedded DSP. The DSP 100 may include at least one portion or an entirety of the memory 98. Additionally or alternatively to the DSP 100, the controller 94 may include at least one application specific integrated circuit (ASIC). The ASIC may be an embedded ASIC. The ASIC may include at least one portion or an entirety of the memory 98.

The memory may communicatively couple to the processor 96. For example, FIG. 3 shows the memory 98 as communicatively coupled to the DSP 100. The memory 98 may include at least one type of non-transitory computer- or processor-readable medium. For example, FIG. 2 shows the memory 98 as including at least one read-only memory (ROM) 102, at least one random-access memory (RAM) 104, and at least one flash memory 106, but can also include registers of the processor(s).

The control unit 16 may include at least one embedded system engineered to serve the specific purposes described herein by, for example, constructing such with dedicated hardware (e.g., gate logic) that executes one or more algorithms described herein or by, for example, computationally specific software that causes one or more components to execute the algorithms described herein. For example, such embedded system may include at least one portion or an entirety of at least one component explained above.

Figure 4:
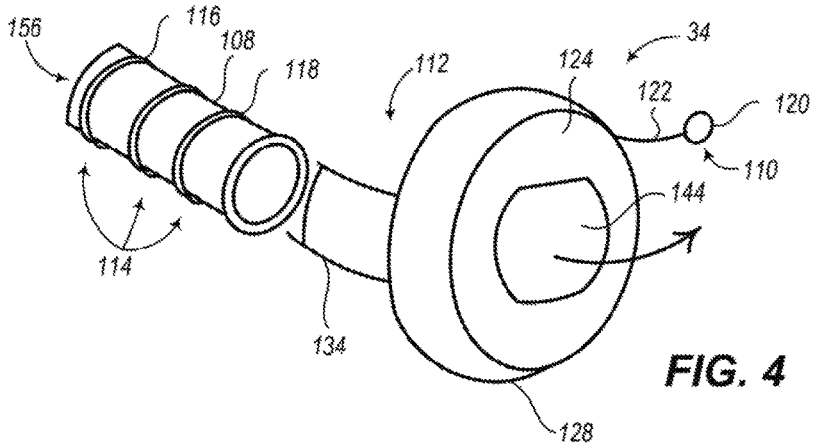
FIG. 4 is a front, left isometric view of an example one of the two ear pieces of FIG. 1, better illustrating various external components of the example ear piece, including at least one housing, at least one resilient body, and at least one ear piece pull, according to at least one illustrated implementation.
Figure 5:
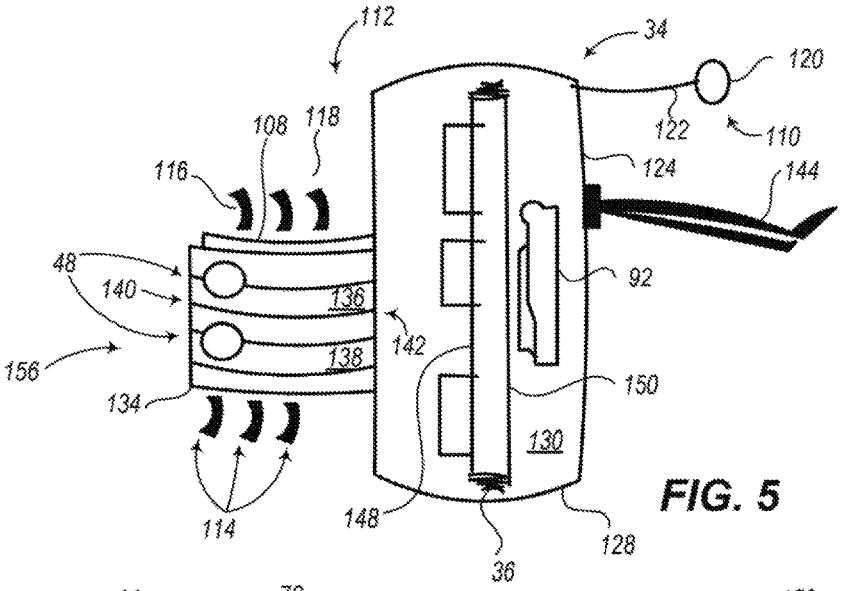
FIG. 5 is a left sectional view of the example ear piece of FIG. 3, better illustrating various external and internal components of the example ear piece, including the at least one housing, the at least one resilient body, the at least one ear piece pull, at least one power storage door in an open position, at least one sound port, at least one in-ear transducer, and circuitry, according to at least one illustrated implementation.

FIGS. 4 and 5 show various components of the example ear piece 34. External components of the example ear piece 34 may include at least one resilient body 108, at least one ear piece pull 110, and at least one housing 112.

At least one of the housing 112 or the resilient body 108 may be sized and dimensioned to permit selective replacement of the resilient body 108. For example, FIG. 4 shows the resilient body 108 as decoupled from the housing 112 while FIG. 5 shows the resilient body 108 as coupled to the housing 112. The resilient body 108 may comprise at least one acoustic damping material (e.g., foam, silicone, silicone rubber, energy absorption resin, etc.). The acoustic damping material may damp at least one of acoustic or mechanical resonance by at least one of absorption or redirection. The resilient body 108 may be sized and dimensioned to resiliently engage an outer portion of the ear canal 62 of the respective ear 64 of the user 18 while the resilient body 108 couples to the housing 112. For example, FIG. 4 shows the resilient body 108 as including flanges 114 that, responsive to insertion of the example ear piece 34 at least partially in the ear canal 62 of the respective ear 64, form a seal with at least an outer portion of the ear canal 62 of the respective ear 64. The flanges 114 may have respective diameters that vary from each other, thereby providing the resilient body 108 a tapered shape (e.g., diameters may increase from a distal flange 116 to a proximate flange 118). At least one of the flanges 114 may have at least one of a dome-shape or disk-shape.

The ear piece pull 110 may be sized and dimensioned to permit the user 18 to remove the example ear piece 34 from the ear canal 62 of the respective ear 64 of the user 18. The ear piece pull 110 may include a knob 120 coupled to a string or wire 122 that couples to the housing 112. For example, FIG. 4 shows the ear piece pull 110 as coupled to a front face 124 of the housing 112.

Figure 8:
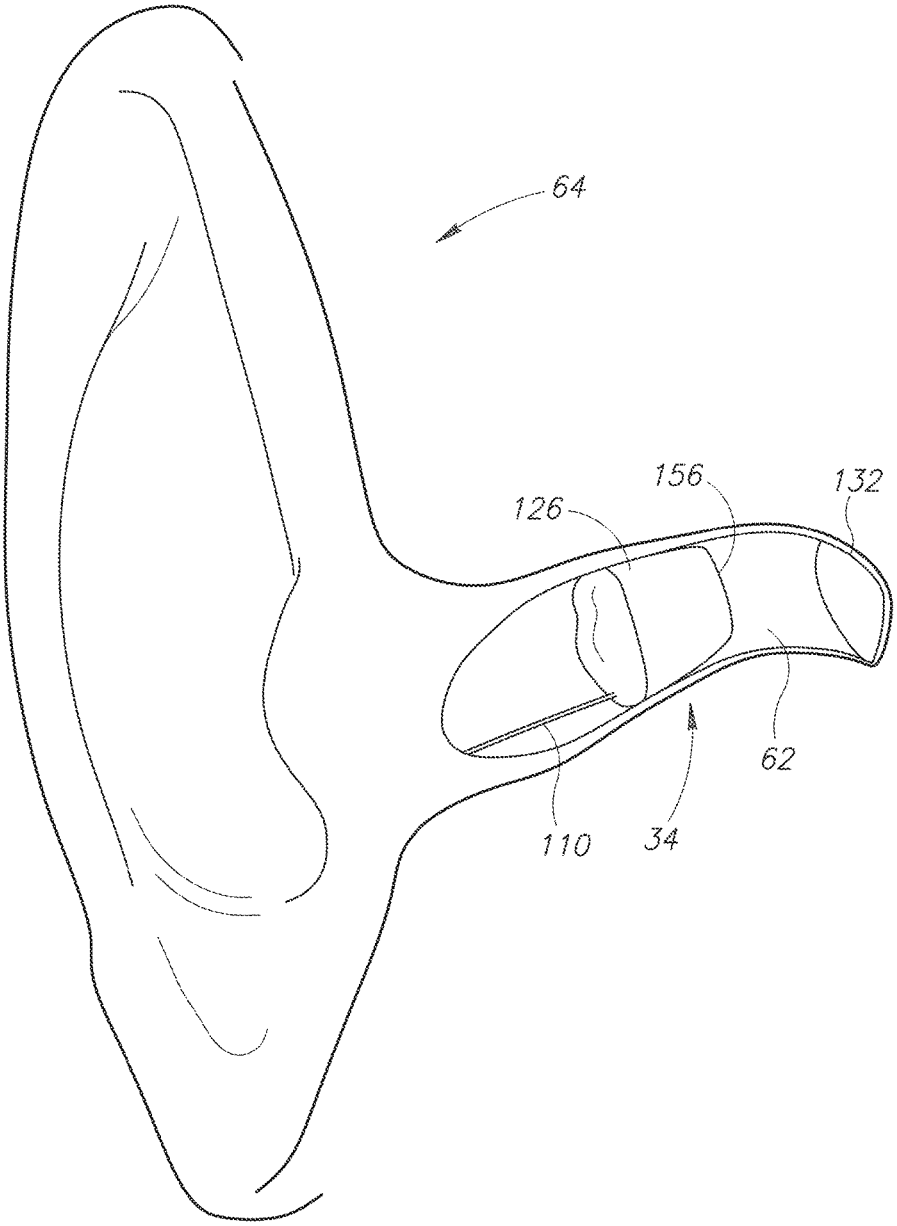
FIG. 8 is right isometric view of an example one of the ear pieces of FIG. 1, better illustrating the example ear piece worn at least partially in the ear canal of the respective ear of the user via a front sectional view of the ear canal of the respective ear of the user, according to at least one illustrated implementation.

The housing 112 may include an in-the-canal (ITC) shell (not shown), a completely-in-canal (CIC) shell (not shown), or an invisible-in-canal (IIC) shell 126 (FIG. 8). For example, FIG. 4 shows the housing 112 as including an in-the-ear shell 128. The housing 112 may be sized and dimensioned to contain various internal components of the example ear piece 34 at least while the housing 112 is positioned at least partially in the ear canal 62 of the respective ear 64 of the user 18. For example, FIG. 5 shows the in-the-ear shell 128 as having at least one compartment 130 that contains at least the circuitry 36 of the example ear piece 34. The housing 112 may be shaped and dimensioned to position at least one portion of the in-ear transducer 48 at a distance from a tympanic membrane 132 of the respective ear 64 while the housing 112 is at least partially in the ear canal 62 of the respective ear where the distance is equal to or less than one-tenth of a wavelength of at least one frequency of the noise generated by the noise source. The frequency may be in the highest tenth of frequencies of the noise generated by the noise source (e.g., 500 Hz, 750 Hz, 1000 Hz, etc.). Alternatively, the frequency may be a highest frequency of interest (e.g., 2000 Hz). The housing 112 may include at least one sound tube 134 coupled to the in-the-ear shell 128 (FIGS. 4 and 5). Alternatively, the sound tube 134 may be integral to, for example, the IIC shell 126 (FIG. 8). For example, FIG. 5 shows the sound tube 134 as including at least one first sound port 136 and at least one second sound port 138 that communicatively couple to a respective one or more of the in-ear transducer 48. The first in-ear transducer 52 may be positioned at a distal end 140 of and internal to a respective one or more of the first sound port 136 or the second sound port 138 while the second in-ear transducer 54 is positioned at a proximate end 142 or the distal end 140 of and internal to another respective one or more of the first sound port 136 or the second sound port 138. Additionally or alternatively, the first in-ear transducer 52 may be positioned at the distal end 140 of and external to the respective one or more of the first sound port 136 or the second sound port 138 while the second in-ear transducer 54 is positioned at the proximate end 142 or the distal end 140 of and internal to the respective one or more of the first sound port 136 or the second sound port 138. Additionally or alternatively, the second in-ear transducer 54 may be positioned in the in-the-ear shell 128 and may be communicatively coupled to the respective one or more of the first sound port 136 or the second sound port 138.

The housing 112 may include at least one power storage door 144. The power storage door 144 may be positioned at the front face 124 of the housing 112. The power storage door 144 may be pivotably coupled to the in-the ear shell 128. For example, FIG. 4 shows the power storage door 144 as being selectively openable to provide access (e.g., as indicated by an arrow that extends away from the power storage door 144) to the power storage 92 (e.g., chemical battery, ultra-capacitor) within the housing 112.

The housing 112 may include at least one first charge interface (not shown). The first charge interface may couple to a second charge interface that is external to the housing 112. For example, a carrying case for carrying the first and second ear pieces 12, 14 may include at least one of the second charge interface to charge the example ear piece 34 via coupling to the first charge interface. Alternatively, at least one second charge interface may be part of a control housing 146 of the control unit 16 (FIG. 1) or electrically coupled thereto. The first charge interface may couple to the second charge interface via at least one of a wired connection or a wireless connection (e.g., inductive charging where the second charging interface is a secondary winding and the first charging interface is a primary winding, spaced sufficiently close together that passage of a current through the primary winding induces a current in the secondary winding). For example, the control housing 146 of the control unit 16 (FIG. 1) may include at least one compartment (not shown). The compartment may be sized and dimensioned to receive at least one of the first ear piece 12 or the second ear piece 14 in at least one specific position or orientation relative to the compartment. The compartment may have at least one of the second charge interface. The first charge interface may be positioned on or internal to the housing 112 at a first position while the second charge interface may be positioned in the compartment at a second position. The first and second positions may cause the first charge interface to communicatively couple (e.g., inductively couple) to the second charge interface responsive to the compartment receiving the at least one of the first ear piece 12 or the second ear piece 14, thereby charging the power storage 92 via, for example, inductive charging.

Each component of the example ear piece 34 that is exposed to an exterior of the example ear piece 34 (e.g., the housing 112, the power storage door 144, etc.) may be waterproof or water resistant. The housing 112 and the power storage door 144 may form at least one waterproof or water resistant seal. The housing 112 may have at least one coating of sealant. For example, the compartment of the control housing 146 may include at least one ear piece cleaner (not shown) that automatically cleans or disinfects at least one of the first ear piece 12 or the second ear piece 14 responsive to the compartment receiving such. For example, such ear piece cleaner may include at least one fluid storage and at least one pump to clean at least one of the first ear piece 12 or the second ear piece 14 by, for example, flooding the compartment with a cleaning solution such as, for example, a solution that comprises alcohol.

The housing 112 (e.g., the front face 124 of the housing 112) may include at least one user interface (e.g., at least one button, knob, switch, etc.) (not shown). The user interface may permit the user 18 to selectively power on or power off the example ear piece 34. The user interface may permit the user 18 to selectively enable or disable the masking noise. The user interface may permit the user 18 to select the masking noise from a defined set of masking noises. The user interface may permit the user 18 to selectively increase or decrease volume of the masking noise.

The housing 112 may include at least one vent (not shown) that, when the example ear piece 34 is positioned at least partially in the ear canal 62 of the respective ear 64 of the user 18, selectively communicatively couples the inner ear canal 62 of the respective ear 64 with environment external to the respective ear 64 responsive to actuation of at least one portion of the user interface. Such may selectively equalize pressure in the inner ear canal 62 of the respective ear 64 with the environment external to the respective ear 64.

Figure 6:
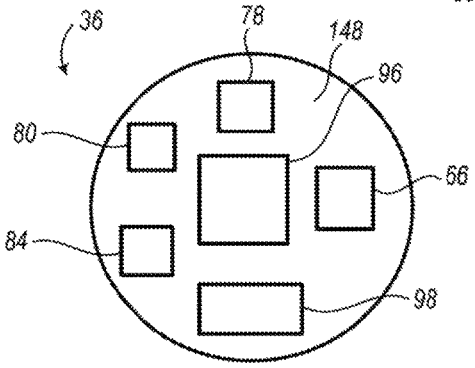
FIG. 6 is a rear plan view of the circuitry of FIG. 5, better illustrating various components of the circuitry, including at least one receiver or transceiver, at least one digital signal processor, at least one analog to digital converter, at least one digital to analog converter, and at least one memory, according to at least one illustrated implementation.
Figure 7:
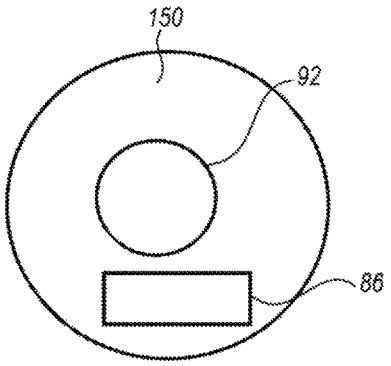
FIG. 7 is a front plan view of the circuitry of FIG. 5, better illustrating various components of the circuitry, including the at least one power supply, and at least one power storage, according to at least one illustrated implementation.

FIGS. 6 and 7 show various components of the circuitry 36 of the example ear piece 34. For example, FIG. 6 shows a rear face 148 of the circuitry 36 as including the radio 66, the analog to digital converter 78 and the analog to digital converter 80 of the pre-processor 76, the digital to analog converter 84 of the post-processor 82, and the processor 96 and the memory 98 of the controller 94. FIG. 7, for example, shows a front face 150 of the circuitry 36 as including the power supply 86 and the power storage 92.

The noise source audio transducer 10 may include one or more components that the present disclosure explains as included with the control unit 16 or one or more of the first or second ear pieces 12, 14. Additionally or alternatively, one or more of the first or second ear pieces 12, 14 may include one or more components that the present disclosure explains as included with the noise source audio transducer 10, the control unit 16, or the other of the first or second ear pieces 12, 14. Additionally or alternatively, the control unit 16 may include one or more components that the present disclosure explains as included with the noise source audio transducer 10 or one or more of the first or second ear pieces 12, 14. For example, the control unit 16 may be an integral part of the noise source audio transducer 10, or the noise source audio transducer 10 may be an integral part of the control unit 16. As another example, the control unit 16 may be an integral part of the example ear piece 34 while the control unit 16 communicatively couples to the other of the first or second ear pieces 12, 14 via a wireless connection such as a respective one of the wireless connections 30, 32. Also for example, one or more of the first or second ear pieces 12, 14 may include an entirety of or at least a portion of the control unit 16. As an additional example, one or more of the first or second ear pieces 12, 14 may be completely passive or partially passive and may derive power from a respective one or more of the wireless connections 30, 32. For another example, at least one component of one or more of the first or second ear pieces 12, 14 may power off between operation of the at least one component while the one or more of the first or second ear pieces 12, 14 is in use to conserve power consumption. Also for example, at least one portion of the power storage 92 may be carried in at least one headband (e.g., at least one sleep mask) of the kit 2 that is wearable by the user 18 while one or more of the first or second ear pieces 12, 14 is in use. As a further example, one or more of the first or second ear pieces 12, 14 may include the user interface while user inputs received by such control both the first and second ear pieces 12, 14. Additionally or alternatively, the control unit 16 may include an entirety or at least one portion of the user interface while user inputs received by such control one or more of the first or second ear pieces 12, 14.

Operation

Figure 9:
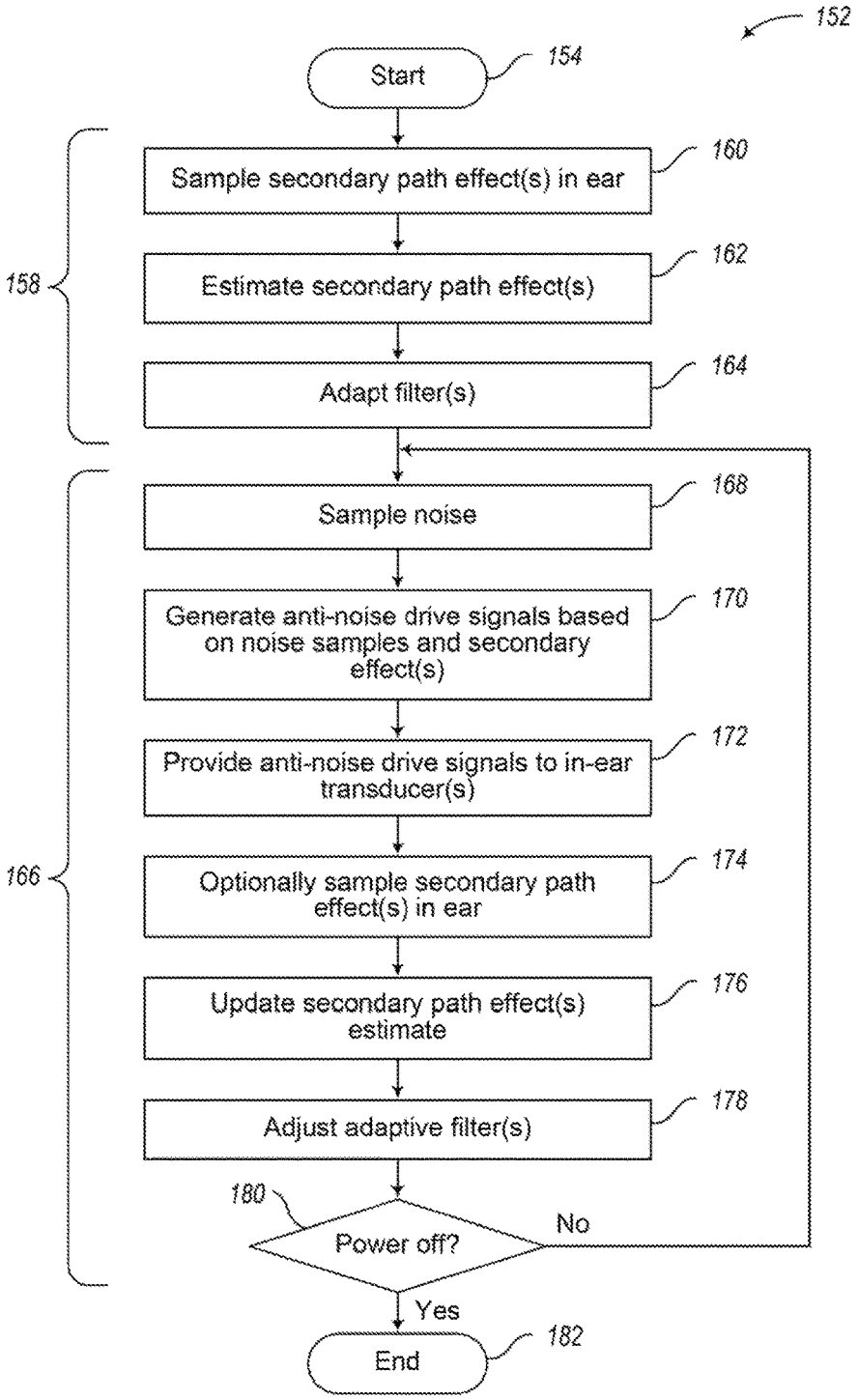
FIG. 9 is a high level flow diagram of an attenuation of snoring noise method in which a training period precedes a run time, no active noise cancellation is performed during the training period, and active noise cancellation is performed during the run time, according to at least one illustrated implementation.

FIG. 9 shows a high level flow diagram of a method 152 of attenuation of noise via operation of the kit 2. The following explains the method 152 primarily with regard to the example ear piece 34 for ease of understanding by the reader.

The method 152 starts at 154. The method 152 may start at 154 responsive to at least one trigger. The trigger may include powering on one or more components of the kit 2 (e.g., one or more of the example ear piece 34 or the control unit 16). Additionally or alternatively, the trigger may include wearing the example ear piece 34 in the ear canal 62 of the respective ear 64 of the user 18. For example, an accelerometer of the example ear piece 34 may detect that a movement of the example ear piece 34 at least one of exceeded or fell below a movement threshold. As another example, the in-ear transducer 48 of the example ear piece 34 may optically or acoustically detect that a detected distance from a distal end 156 of the housing 112 at least one of exceeded or fell below a distance threshold. Also for example, an ambient light sensor of the example ear piece 34 or the in-ear transducer 48 may detect that a detected ambient light at least one of exceeded or fell below an ambient light threshold. Additionally or alternatively, the trigger may include removing the example ear piece 34 from the compartment of the control housing 146. Additionally or alternatively, the trigger may include inputting at least one user input via the user interface.

Responsive to the start 154 of the method 152, the kit 2 enters a training period 158. No active noise cancellation is performed during the entirety of the training period 158. For example, none of the components of the kit 2 perform active noise cancellation during the training period. As another example, responsive to a given one of the first ear piece 12 or the second ear piece 14 participating in the training period 158, the given one of the first ear piece 12 or the second ear piece 14 does not perform active noise cancellation during the training period 158.

At 160, at least one component of the kit 2 may sample at least one secondary path effect in the ear canal 62 of the respective ear 64. The processor 96 (e.g., the DSP 100) or other component may generate at least one defined reference noise signal that is representative of at least one defined reference noise. For example, the defined reference noise may be white noise. Alternatively, the defined reference noise may be at least one of pink noise, red noise, or grey noise. The processor 96 may provide the defined reference noise signal to the in-ear transducer 48 of the example ear piece 34 (e.g., via communicative coupling as explained above). The processor 96 or some other component may also provide the defined reference noise to an adaptive filter, which may be denominated as the secondary path characterization adaptive filter, which adjusts or adapts based on a secondary path characterization error signal from an in-ear transducer. The secondary path characterization error signal is produced in response to the production of the defined reference noise in the respective ear canal by an in-ear transducer. The secondary path characterization adaptive filter produces a characterization of the secondary effects, which can be used in the generation of the anti-noise signal. In particular, the secondary path estimate can be applied to the one or more adaptive filters, which may be denominated as an anti-noise adaptive filter, along with the signal representative of the noise and the error signal that represents the discrepancy between the noise and the anti-noise, to produce an updated anti-noise signal. While generally discussed in terms of a secondary path characterization adaptive filter, there are cases where the secondary-path estimate is fixed since it is possible to model the average ear and average positioning of the earpiece. Thus, the secondary-path estimate or characterization can be accomplished by the processor 96 without the use of an adaptive filter.

Responsive to the defined reference noise signal, the in-ear transducer 48 produces the defined reference noise as explained above. The defined reference noise may include at least one defined frequency, defined frequency range, or defined set of frequencies or frequency ranges. In the frequency domain, at least one portion of the defined reference noise may overlap or coincide with at least one portion of the noise generated by the noise source during a prior use of at least one component of the kit 2. At least one component of the kit 2 (e.g., in-ear transducer 48) may sample the secondary path effect in the ear canal 62 of the respective ear 64 at least once at 160. The defined reference noise may be continuous for at least one defined duration while at least one frequency, frequency range, or set of frequencies or frequency ranges of the defined reference noise varies during at least one defined portion of the defined duration.

The in-ear transducer 48 may detect the defined reference noise or at least one reflection of the reference noise in the ear canal 62 of the respective ear 64 as explained above. For example, the defined reference noise may travel from the distal end 156 of the housing 112 while the housing 112 is at least partially in the ear canal 62 of the respective ear 64 and reflect off at least one portion of the respective ear 64 (e.g., tympanic membrane 132 of the respective ear 64). The in-ear transducer 48 may detect the secondary path effect that occurs in the ear canal 62 of the respective ear 64. For example, the in-ear transducer 48 may detect the defined reference noise or the reflection of the reference noise in the ear canal 62 of the respective ear 64 responsive to the in-ear transducer 48 ceasing production of the defined reference noise. Additionally or alternatively, the in-ear transducer 48 may detect the defined reference noise or the reflection of the defined reference noise while the in-ear transducer 48 produces the defined reference noise. For example, the in-ear transducer 48 may detect at least one portion of the defined reference noise or the reflection of the reference noise where the portion has at least one frequency or frequency range that is different than at least one frequency or frequency range of at least one defined reference noise portion that the in-ear transducer 48 produces concurrent to such detection. The in-ear transducer 48 may be positioned to at least primarily detect the reflection of the defined reference noise as explained above. For example, the first and second in-ear transducers 52, 54 may be positioned in respective ones of the first or second sound ports 136, 138. As another example, the first in-ear transducer 52 may be positioned external to the sound tube 134 while the second in-ear transducer 54 is positioned internal to the sound tube 134. Additionally or alternatively, the at least on in-ear transducer 48 may be directional as explained above, thereby primarily detecting the reflection of the defined reference noise. Responsive to the in-ear transducer 48 detecting the defined reference noise or the reflection of the defined reference noise, the in-ear transducer 48 may produce at least one signal representative of at least one secondary path effect in the ear canal 62 of the respective ear 64 or set of secondary path effects in the ear canal 62 of the respective ear 64. The in-ear transducer 48 may provide the signal representative of the secondary path effect or set of secondary path effects to the processor 96 or secondary path effects adaptive filter (e.g., via communicative coupling as explained above).

Responsive to receiving the signal representative of the secondary path effect or set of secondary path effects, at least one component of the kit 2 may estimate the secondary path effect or set of secondary path effects that occur in the ear canal 62 of the respective ear 64 at 162. For example, the processor 96 or secondary path effects adaptive filter may compare at least one signal representative of the secondary path effect(s) or at least one portion of the signal representative of the secondary path effect(s) to at least one defined reference noise signal or at least one portion of the defined reference noise signal to produce at least one secondary path effect comparison result or a secondary path effects characterization. The processor 96 may convert such signals from the time domain to the frequency domain and may make such comparison in the frequency domain. The secondary path effect comparison result may represent acoustic superposition of at least one path that at least one of the defined reference noise or the reflection of the defined reference noise travels. For example, the secondary path effect comparison result may represent acoustic superposition between the first in-ear transducer 52 and the second in-ear transducer 54 (e.g., where the first in-ear transducer 52 detects the defined reference noise as explained above). As another example, the secondary path effect comparison result may represent acoustic superposition between the in-ear transducer 48 to the portion of the respective ear 64 (e.g., tympanic membrane 132 of the respective ear 64) that the defined reference noise reflects off (e.g., where the in-ear transducer 48 optically detects movement of the portion of the respective ear 64). As an additional example, the secondary path effect comparison result may represent acoustic superposition where the defined reference noise travels from the in-ear transducer 48 to the portion of the respective ear 64 that the defined reference noise reflects off and where the reflection of the defined reference noise from the portion of the respective ear 64 to the in-ear transducer 48 (e.g., where the in-ear transducer 48 detects the reflection of the defined reference noise). Additionally to the acoustic superposition of the path, the secondary path effect comparison result may represent at least one change to at least one signal (e.g., at least one of the defined reference noise signal or the signal representative of the secondary path effect or set of secondary path effects) where at least one component between the processor 96 or secondary path effects adaptive filter and the in-ear transducer 48 (including the in-ear transducer 48) makes such change (e.g., at least one portion of at least one of the post-processor 82 of the control unit 16, the radio 66 of the control unit 16 that transmits the defined reference noise signal, the radio 50 of the example ear piece 34 that receives the defined reference noise signal, the in-ear transducer 48 that produces the defined reference noise, the in-ear transducer 48 that detects the defined reference noise or the reflection of the defined reference noise, the radio 50 that transmits the signal representative of the secondary path effect or set of secondary path effects, the radio 66 that receives the signal representative of the secondary path effect or set of secondary path effects, or the pre-processor 76 of the control unit 16).

The characterization or estimate of the secondary path effect can be applied to the anti-noise adaptive filter at 164. For example, the processor 96 or the anti-noise adaptive filter may adjust to compensate for the secondary path effect or set of secondary path effects that occur in the ear canal 62 of the respective ear 64. The processor 96 may adjust at least one characteristic of the anti-noise adaptive filter based on the signal representative of the secondary path effect or set of secondary path effects. For example, the adjustment to the characteristic of the anti-noise adaptive filter may update at least one definition of, for example, at least one of time domain magnitude or spectral responses of the anti-noise adaptive filter. The processor 96 or anti-noise adaptive filter may configure or adjust based at least in part on at least one transfer function or impulse response of the secondary path in the ear canal 62 of the respective ear 64. The processor 96 or anti-noise adaptive filter may configure or adjust only at one or more times or portions of the method 152 explained herein. Alternatively, the processor 96 or anti-noise adaptive filter may continuously configure or adjust. The anti-noise adaptive filter may be a digital adaptive filter. For example, the anti-noise adaptive filter may be a finite impulse response (FIR) digital filter. The anti-noise adaptive filter may be a partitioned filter.

At least one component of kit 2 may repeat the training period 158 at least once for at least one of the first or second ear pieces 12, 14. At least one component of the kit 2 may repeat the training period 158 for a predetermined number of repetitions for at least one of the first or second ear pieces 12, 14. At least one component of the kit 2 may repeat the training period 158 until a predetermined time period expires (e.g., three seconds from entering the training period 158). Additionally or alternatively, at least one component of the kit 2 may repeat the training period 158 for at least one of the first or second ear pieces 12, 14 until the anti-noise adaptive filter converges (e.g., when the output signal of the anti-noise adaptive filter matches the signal representative of the secondary path effect or set of secondary path effects or when a difference between the output signal of the anti-noise adaptive filter and the signal representative of the secondary path effect or set of secondary path effects is below at least one defined or predefined threshold). At least one component of the kit 2 may repeat the training period 158 for at least one of the first or second ear pieces 12, 14 until at least one of the anti-noise adaptive filter converges, the predetermined number of repetitions occurs, or the predetermined time period expires, whichever comes first.

Responsive to conclusion of the training period 158, the kit 2 enters a run time 166. Active noise cancellation is performed during at least one portion of the run time 166. For example, responsive to the given one of the first ear piece 12 or the second ear piece 14 entering the run time 166, the given one of the first ear piece 12 or the second ear piece 14 performs active noise cancellation during the run time 166.

At 168, at least one component of the kit 2 may sample noise generated by the noise source. As explained above, the noise source audio transducer 10 may detect noise generated by the noise source and may provide signals representative of such noise generated by the noise source to the control unit 16 (e.g., via communicative coupling as explained above). Responsive to receiving at least one signal representative of noise generated by the noise source, the processor 96 or the anti-noise adaptive filter may sample at least one portion of the signal representative of noise generated by the noise source. For example, the processor 96 or the anti-noise adaptive filter may determine at least one phase, amplitude, frequency, noise cycle (e.g., where the noise source intermittently or periodically generates the noise, the noise cycle may be a time period between a first start of the noise and an immediately subsequent start of the noise), or duty cycle (e.g., where the noise source intermittently or periodically generates the noise, the duty cycle may reflect a percentage of the noise cycle where the noise source generates the noise during the percentage of the noise cycle) of the detected noise generated by the noise source. The processor 96 or the anti-noise adaptive filter may convert the received signal representative of noise generated by the noise source from the time domain to the frequency domain and may make at least one of such determinations in the frequency domain.

Responsive to sampling the noise generated by the noise source, at least one component of the kit 2 may generate at least one anti-noise drive signal based on at least one noise sample (e.g., at least one noise sample as explained above) and at least one estimated secondary effect (e.g., at least one estimated secondary effect as explained above) at 170. For example, the anti-noise adaptive filter may filter the noise sample, thereby compensating for at least one of acoustics of the ear canal 62 of the respective ear 64 or position of the example ear piece 34 in the ear canal 62. Additionally or alternatively, the anti-noise adaptive filter may have at least one fixed (i.e., non-adaptive) property. The fixed property may be predetermined based at least in part on at least one secondary path effects estimate model of at least one of an average ear or an average position of the example ear piece 34 in the ear canal 62. The at least one processor 96 may implement at least one algorithm explained herein to adjust or adapt the adaptive filter. The at least one processor 96 may implement the adaptive filter. The processor 96 may apply at least one anti-noise filter to the noise signal. The processor 96 may adjust at least one characteristic of the anti-noise adaptive filter based at least in part on at least one of the noise sample, the noise error signal, and optionally the estimated secondary effect. For example, alternatively to the anti-noise adaptive filter being separate and distinct from the secondary path effects adaptive filter, the anti-noise adaptive filter may be or may include the secondary path effects adaptive filter. The processor 96 may configure or adjust the anti-noise adaptive filter according to the estimated secondary path effects as explained above.

The adjustment to the characteristic of the anti-noise adaptive filter may update at least one definition of, for example, at least one of time domain magnitude or spectral responses of the anti-noise adaptive filter. The anti-noise adaptive filter may be a digital adaptive filter. For example, the anti-noise adaptive filter may be a finite impulse response (FIR) digital filter. The anti-noise adaptive filter may be a least mean squares (LMS) adaptive filter. For example, the anti-noise adaptive filter may be a filtered-x LMS adaptive filter. The anti-noise adaptive filter may be a partitioned filter. Additionally or alternatively, the anti-noise adaptive filter may be implemented by at least one processor 96. For example, the one or more of the at least one processor 96 may implement at least one algorithm explained herein to adjust the anti-noise adaptive filter.

Responsive to generating the anti-noise drive signal, the control unit 16 may provide the anti-noise drive signal to the in-ear transducer 48 at 172 (e.g., via communicative coupling as explained above). As explained above, the in-ear transducer 48 may produce anti-noise responsive to the anti-noise drive signal. The in-ear transducer 48 may cancel or substantially cancel (i.e., noise reduction by at least one of, for example, 5-10 decibels, 10-15 decibels, 15-20 decibels, 20-25 decibels, 25-30 decibels, 30-35 decibels, or 35-40 decibels with regard to at least one frequency range of at least one of, for example, 20-125 Hz, 125-250 Hz, 250-500 Hz, 500-1000 Hz, 1000-1500 Hz, or 1500-2000 Hz) at least one portion of the noise generated by the noise source while the in-ear transducer 48 is at least partially within the ear canal 62 of the respective ear 64 of the user 18. For example, the anti-noise may have at least one amplitude that is equal or similar to at least one amplitude of the noise generated by the noise source. The anti-noise may have at least one frequency, frequency range, or set of frequencies or frequency ranges that is equal or similar to at least one of such of the noise generated by the noise source.

The in-ear transducer 48 may detect at least one portion of the noise generated by the noise source while such occurs in the ear canal 62 of the respective ear 64 of the user 18. For example, the in-ear transducer 48 may delay production of the anti-noise until after the in-ear transducer 48 detects the portion of the noise. The in-ear transducer 48 may not produce the anti-noise during the first noise cycle of the run time or during at least one portion of the first noise cycle of the run time. Alternatively, the in-ear transducer 48 may actively cancel only a portion that is less than all frequencies or frequency ranges of the noise generated by the noise source during the first noise cycle of the run time or during at least one portion of the first noise cycle of the run time. For example, only for each subsequent noise cycle of the run time, the in-ear transducer 48 may perform active noise cancellation as in its normal use during the run time 166 while detecting differences between the noise (e.g., snoring) and the anti-noise, i.e., detecting at least one portion of at least one of unsuccessfully canceled noise or anti-noise. Alternatively to such applying only to subsequent noise cycles of the run time 166, such may also apply to the first noise cycle of the run time 166. The in-ear transducer 48 may provide at least one error signal representative of the detected portion of the differences between the noise (e.g., snoring) and the anti-noise to the control unit 16 (e.g., via communicative coupling as explained above).

Responsive to the error signal, the processor 96 or anti-noise adaptive filter may compare the error signal to at least one portion of the received signal representative of noise generated by the noise source. The processor 96 or anti-noise adaptive filter may convert such signals from the time domain to the frequency domain and may make such comparison in the frequency domain. The comparison of such signals may represent at least one of attenuation of the noise at least by the resilient body 108 of the example ear piece 34 or acoustics of the bedroom 4. Additionally or alternatively, the comparison of such signals may represent a change in superposition of such signals in the ear canal 62 due to, for example, a positional shift of the example ear piece 34 relative to the ear canal 62. The processor 96 or anti-noise adaptive filter may adjust or adapt based at least in part on the comparison. For example, the processor 96 may adjust the anti-noise filter or anti-noise adaptive filter may adapt to cause the anti-noise drive signal to approach an inverse of the received signal representative of noise generated by the noise source, minus the error signal. Such may cause the in-ear transducer 48 to produce adjusted anti-noise that actively cancels the noise with a lower magnitude of error than that prior to such adjustment, thereby enhancing the active noise cancellation.

Additionally or alternatively, the example ear piece 34 may include at least one frequency mixer, analog multiplier, or circuit that provides a phase comparison between the noise generated by the noise source and the anti-noise. For example, the example ear piece 34 may include at least one phase comparator (not shown). The phase comparator of the example ear piece 34 may compare at least one phase of the detected portion of the noise and at least one phase of at least one of the anti-noise or the anti-noise drive signal. Such may include a comparison between the error signal and the anti-noise or the anti-noise drive signal. Responsive to the phase comparator detecting at least one phase difference (e.g., detecting whether such phase difference exceeds or falls below at least one threshold), the in-ear transducer 48 may apply at least one phase shift to at least one of the anti-noise or the anti-noise drive signal. The phase shift may have at least one predetermined magnitude. Alternatively, the phase shift may have a magnitude that is proportional to at least one magnitude of the detected phase difference. For example, with regard to the noise generated by the noise source, the anti-noise may have at least one opposite or nearly opposite phase. By producing such anti-noise, the in-ear transducer 48 performs enhanced active noise cancellation.

Optionally, at 174, at least one component of the kit 2 may sample at least one secondary path effect in the ear canal 62 of the respective ear 64 during the run time 166 while active noise cancellation is performed. At least one such component may execute at least one portion of act 160 of the training period 158 while active noise cancellation is performed. For example, the in-ear transducer 48 may superimpose the defined reference noise over the anti-noise responsive to the processor 96 superimposing the defined reference noise signal over the anti-noise signal. While active noise cancellation is performed, the in-ear transducer 48 may detect the defined reference noise or at least one reflection of the reference noise in the ear canal 62 of the respective ear 64 as explained above. The in-ear transducer 48 may provide at least one signal representative of the secondary path effect or set of secondary path effects to the control unit 16. Such may occur only while the in-ear transducer 48 produces anti-noise responsive to the anti-noise drive signal. Such may occur on each repetition of the run time 166 or on non-sequential repetitions of the run time 166. Accordingly, implementing this option permits adjusting the secondary path effects adaptive filter responsive to at least one positional shift of the example ear piece 34 in the ear canal 62 of the respective ear 64. Additionally or alternatively, implementing this option permits at least one component of the kit 2 to omit the training period 158.

Responsive to receiving the signal representative of the secondary path effect or set of secondary path effects, the control unit 16 may update the estimated secondary path effect or secondary path effects characterization that occur in the ear canal 62 of the respective ear 64 at 176. For example, the processor 96 or secondary path effects adaptive filter may execute at least one portion of act 162 of the training period 158.

Responsive to updating the estimated secondary path effect or secondary path effects characterization that occur in the ear canal 62 of the respective ear 64, at least one component of the kit 2 may adjust at least one of the anti-noise adaptive filter based on the updated estimated secondary path effect or secondary path effects characterization at 178. For example, the processor 96 may adjust at least one of the anti-noise adaptive filter or the anti-noise filter may self adjust to compensate for the updated estimated secondary path effect or secondary path effects characterization in similar fashion as explained above at act 164 of the training period 158.

At least one component of the kit 2 may repeat at least one portion of the run time 166 at least once for at least one of the first or second ear pieces 12, 14 during at least one cycle of the run time 166. At least one component of the kit 2 may repeat the at least one portion of the run time 166 for a predetermined number of repetitions for at least one of the first or second ear pieces 12, 14. At least one component of the kit 2 may repeat the portion of the run time 166 until a predetermined time period expires (e.g., three seconds from entering the run time 166). Additionally or alternatively, at least one component of the kit 2 may repeat the portion of the run time 166 for at least one of the first or second ear pieces 12, 14 until at least one of the secondary effects adaptive filter or the anti-noise adaptive filter converges (e.g., when the output signal of such matches the signal representative of the detected portion of the noise or when a difference between the output signal of such and the signal representative of the detected portion of the noise is below at least one defined or predefined threshold). At least one component of the kit 2 may repeat the portion of the run time 166 for at least one of the first or second ear pieces 12, 14 until at least one of the secondary effects adaptive filter converges, the anti-noise adaptive filter converges, the predetermined number of repetitions occurs, or the predetermined time period expires, whichever comes first.

At 180, at least one component of the kit 2 may determine whether to power off at least one component of the kit 2 (e.g., at least one of the noise source audio transducer 10, the first ear piece 12, the second ear piece 14, or the control unit 16). Responsive to such determination resulting in a negative determination (e.g., power remains on for the component of the kit 2), the run time 166 repeats. Responsive to such determination resulting in a positive determination (e.g., powering off the component of the kit 2), method 152 ends at 182.

Figure 10:
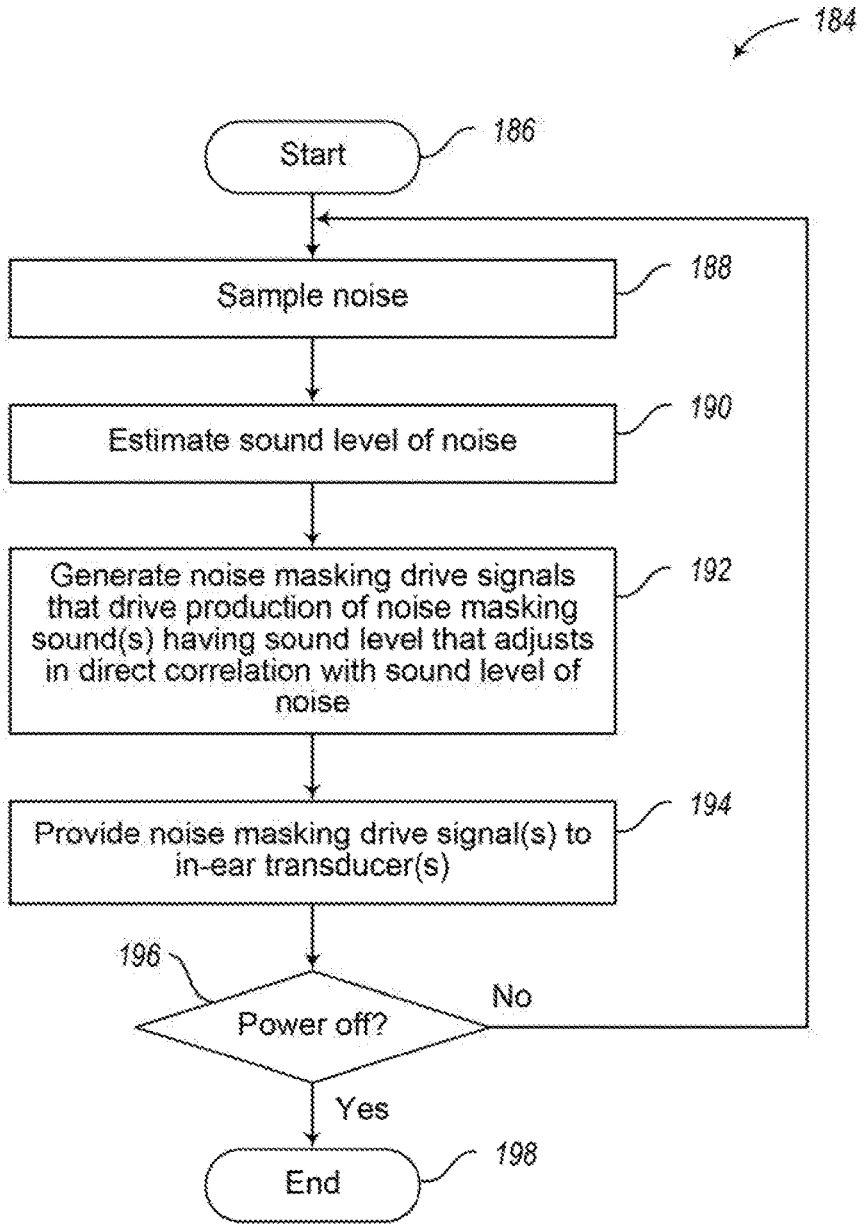
FIG. 10 is a high level flow diagram of a masking noise method that may run in parallel to the run time of FIG. 9, according to at least one illustrated implementation.

FIG. 10 shows a high level flow diagram of a method 184 of masking of noise via operation of the kit 2. The following explains the method 184 primarily with regard to the example ear piece 34 for ease of understanding by the reader.

The method 184 starts at 186. The method 184 may start at 186 responsive to at least one trigger as, for example, explained at 154 of the method 152. The method 184 may run in parallel to at least one portion of the method 152. For example, the trigger may be entry into the run time 166 of the method 152.

Responsive to the start 186 of the method 184, at least one component of the kit 2 may sample noise generated by the noise source at 188. The method 184 may share at least one act with the run time 166 of the method 152. For example, at least one component of the kit 2 may sample the noise generated by the noise source at 188 as explained at 168.

Responsive to sampling the noise generated by the noise source, at least one component of the kit 2 may estimate at least one sound level of the noise generated by the noise source at 190. The processor 96 may determine at least one sound level peak of the noise generated by the noise source. The processor 96 may determine at least one temporal point in the noise cycle that the sound level peak occurs. For example, the processor 96 may predict the sound level at one or more respective temporal points in the noise cycle based at least in part on at least one prior noise cycle. Such may occur as at least one portion of the method 152 (e.g., at one or more of 168 or 170).

Responsive to estimating the sound level of the noise generated by the noise source, at least one component of the kit 2 may generate at least one masking noise signal at 192. The processor 96 may generate at least one masking noise signal that drives production of at least one masking noise that has at least one sound level that adjusts according to the sound level of the noise generated by the noise source. The sound level of the masking noise may adjust in synchronization with the sound level of the noise generated by the noise source. The sound level of the masking noise may adjust in direct correlation with the sound level of the noise generated by the noise source (e.g., the sound levels of the masking noise and the noise generated by the noise source concurrently increase or concurrently decrease). For example, the processor 96 may temporally shift the masking noise forward or backward based at least in part on correlation between the predicted or detected sound level of the noise and the sound level of the masking noise at each of the one or more respective temporal points in the immediately prior noise cycle. Additionally or alternatively, the processor 96 may increase or decrease at least one duration or duty cycle of the masking noise based at least in part on correlation between the predicted or detected sound level of the noise and the sound level of the masking noise at each of the one or more respective temporal points in the immediately prior noise cycle. For example, where the masking noise includes ocean waves crashing on a beach, breaking of an ocean wave may occur during a loudest duration of the noise cycle of the noise generated by the noise source.

Responsive to generating the masking noise signal, the control unit 16 may provide the masking noise signal to the in-ear transducer 48 at 194 (e.g., via communicative coupling as explained above). As explained above, the in-ear transducer 48 may produce the masking noise responsive to the masking noise signal. The masking noise may include at least one cyclic or periodic noise (e.g., ocean waves crashing, rain, thunder). For example, at least one component of the kit 2 may apply the masking noise as the defined reference noise during the training period 158. As explained above, the user interface may permit the user 18 to select the masking noise from a defined set of masking noises. The user interface may permit the user 18 to selectively enable or disable the masking noise as explained above. The example ear piece 34 may store data representative of at least one of the masking noise or the set of masking noises. For example, the masking noise signal may instruct the in-ear transducer 48 with regard to at least one of when to produce the masking noise or at least one sound level of the masking noise at one or more points in time. Alternatively, the example ear piece 34 may derive the masking noise signal from the anti-noise drive signal. For example, the example ear piece 34 may produce the masking noise responsive to the anti-noise drive signal. As another example, the example ear piece 34 may derive the sound level of the masking noise from at least one amplitude of the anti-noise that the anti-noise drive signal represents. Alternatively, the example ear piece 34 may not store data representative of the masking noise prior to receiving the masking noise signal. For example, the masking noise signal may include at least one portion of the above-explained information with regard to the masking noise, thereby directly driving production of the masking noise via the masking noise signal.

At 196, at least one component of the kit 2 may determine whether to power off at least one component of the kit 2 as explained above with regard to 180 of the method 152. Responsive to such determination resulting in a negative determination, the method 184 repeats as explained above with regard to 180 of the method 152. Responsive to such determination resulting in a positive determination, method 196 ends at 198 as explained above with regard to 182 of the method 152.

At least one component of the kit 2 may omit at least one portion of at least one of the method 152 or the method 196 during at least one repetition through such portion. At least one component of the kit 2 may omit such portion on a given repetition and may include such portion on a subsequent repetition. For example, responsive to such portion resulting in an outcome that is different from an immediately prior outcome of an immediately prior repetition through such portion, the processor 96 may determine whether the difference at least one of exceeds or falls below at least one predefined threshold. Responsive to determining that the difference at least one of exceeds or falls below at least one predefined threshold, the processor 96 may selectively omit such portion and rely on the above-explained resulting outcome. The processor 96 may include such portion after at least one of a predetermined number of omissions, a predetermined amount of time, or a detection that at least one other outcome of at least one other portion changed with regard to at least one immediately prior other outcome of the other portion. For example, the processor 96 may temporarily omit updating the estimated secondary path effect or set of secondary path effects that occur in the ear canal 62 of the respective ear 64 at 176 of the method 152.

The above description of illustrated implementations, including what is described in the Abstract, is not intended to be exhaustive or to limit the implementations to the precise forms disclosed. Although specific implementations of and examples are described herein for illustrative purposes, various equivalent modifications can be made without departing from the spirit and scope of the disclosure, as will be recognized by those skilled in the relevant art. The teachings provided herein of the various implementations can be applied to other systems, not necessarily the exemplary systems generally described above.

The foregoing detailed description has set forth various implementations of the devices and/or processes via the use of block diagrams, schematics, and examples. Insofar as such block diagrams, schematics, and examples contain one or more functions and/or operations, it will be understood by those skilled in the art that each function and/or operation within such block diagrams, flowcharts, or examples can be implemented, individually and/or collectively, by a wide range of hardware, software, firmware, or virtually any combination thereof. In one implementation, the present subject matter may be implemented via application-specific integrated circuits (ASICs). However, those skilled in the art will recognize that the implementations disclosed herein, in whole or in part, can be equivalently implemented in standard integrated circuits, as one or more computer programs running on one or more computers (e.g., as one or more programs running on one or more computer systems), as one or more programs running on one or more controllers (e.g., microcontrollers) as one or more programs running on one or more processors (e.g., microprocessors), as firmware, or as virtually any combination thereof, and that designing the circuitry and/or writing the code for the software and or firmware would be well within the skill of one of ordinary skill in the art in light of this disclosure.

Those of skill in the art will recognize that many of the methods or algorithms set out herein may employ additional acts, may omit some acts, and/or may execute acts in a different order than specified.

In addition, those skilled in the art will appreciate that the mechanisms taught herein are capable of being distributed as a program product in a variety of forms, and that an illustrative implementation applies equally regardless of the particular type of signal bearing media used to actually carry out the distribution. Examples of signal bearing media include, but are not limited to, the following: recordable type media such as floppy disks, hard disk drives, CD ROMs, digital tape, and computer memory.

The various implementations described above can be combined to provide further implementations. All of the U.S. patents, U.S. patent application publications, U.S. patent applications, foreign patents, foreign patent applications and non-patent publications referred to in this specification and/or listed in the Application Data Sheet, including but not limited to U.S. Provisional Patent Application Ser. No. 62/333,619, filed May 9, 2016, and entitled "Snoring Active Noise-Cancellation, Masking, and Suppression," are incorporated herein by reference, in their entirety. Aspects of the implementations can be modified, if necessary, to employ systems, circuits, and concepts to provide yet further implementations.

These and other changes can be made to the implementations in light of the above-detailed description. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

The invention claimed is:

1. A kit for attenuation of noise, comprising:

a noise source audio transducer, the noise source audio transducer positionable in use proximate a source of noise;

a first ear piece wearable at least partially in an ear canal of a first ear of a user who is not the source of noise, the first ear piece including at least one resilient body, at least one in-ear audio transducer, and at least one radio, the at least one resilient body sized and dimensioned to resiliently engage an outer portion of the ear canal, the at least one in-ear audio transducer spaced to be positioned in an inner portion of the ear canal within a first defined distance from a respective tympanic membrane associated with the ear canal of the first ear, when the at least one resilient body resiliently engages the outer portion of the ear canal, the first defined distance which is equal to or less than one-tenth of a wavelength of at least one frequency in a snoring noise, the at least one frequency which is between 1135 Hz and 2000 Hz, the at least one radio communicatively coupled to provide drive signals to drive the at least one in-ear audio transducer to produce anti-noise and to transmit error signals representative of a discrepancy between the noise and the anti-noise in the ear canal of the first ear detected by the at least one in-ear audio transducer;

a second ear piece wearable at least partially in an ear canal of a second ear of the user, the second ear piece including at least one resilient body, at least one in-ear audio transducer, and at least one radio, the at least one resilient body sized and dimensioned to resiliently engage an outer portion of the ear canal, the at least one in-ear audio transducer spaced to be positioned in an inner portion of the ear canal within a second defined distance from a respective tympanic membrane associated with the ear canal of the second ear, when the at least one resilient body resiliently engages the outer portion of the ear canal, the second defined distance which is equal to or less than one-tenth of a wavelength of at least one frequency in a snoring noise, the at least one frequency which is between 1135 Hz and 2000 Hz, the at least one radio communicatively coupled to provide drive signals to drive the at least one in-ear audio transducer to produce anti-noise and to transmit error signals representative of a discrepancy between the noise and the anti-noise in the ear canal of the second ear detected by the at least one in-ear audio transducer; and a control unit including at least one radio and at least one antenna, the at least one radio and the at least one antenna communicatively coupleable to: i) the noise source audio transducer to receive signals representative of noise generated by the noise source, ii) the at least one radio of the first ear piece to receive error signals representative of the discrepancy between the noise and the anti-noise in the ear canal of the first ear and to provide signals representative of an anti-noise to be generated by the at least one in-ear audio transducer of the first ear piece, and iii) the at least one radio of the second ear piece to receive error signals representative of the discrepancy between the noise and the anti-noise in the ear canal of the second ear and to provide signals representative of an anti-noise to be generated by the at least one in-ear audio transducer of the second ear piece.

2. The kit of claim 1, further comprising:

a noise source transmitter communicatively coupled to the noise source audio transducer, and operable, in use, to transmit noise signals representative of noise created by the noise source to the control unit.

3. The kit of claim 2 wherein the noise source transmitter is one of a low latency radio or optical transmitter.

4. The kit of claim 1, further comprising:

a tether that communicatively couples the noise source audio transducer with the control unit.

5. The kit of claim 1 wherein the at least one in-ear transducer of the first ear piece includes: a first in-ear transducer that produces the error signals representative of the discrepancy between the noise and the anti-noise in the ear canal and a second in-ear transducer responsive to anti-noise drive signals to produce anti-noise.

6. The kit of claim 1 wherein the at least one in-ear transducer of the first ear piece includes: a single in-ear transducer that produces the error signals representative of the discrepancy between the noise and the anti-noise in the ear canal of the first ear in the ear canal and is responsive to anti-noise drive signals to produce anti-noise.

7. The kit of claim 1 wherein the control unit comprises circuitry including at least one digital signal processor that generates signals representative of an anti-noise to be generated by the at least one in-ear audio transducer of the first or the second ear pieces to perform active noise cancellation, wherein the at least one digital signal processor generates signals representative of the anti-noise to be generated based at least in part on signals representative of noise generated by the noise source and the error signals.

8. The kit of claim 7 wherein the at least one radio of the first ear piece is communicatively coupled to receive secondary path characterizing signals representative of secondary path effects in the ear canal of the first ear detected by the at least one in-ear audio transducer and to transmit the secondary path characterizing signals to the radio of the control unit and the at least one radio of the second ear piece is communicatively coupled to receive secondary path characterizing signals representative of secondary path effects in the ear canal of the second ear detected by the at least one in-ear audio transducer and to transmit the secondary path characterizing signals to the radio of the control unit.

9. The kit of claim 8 wherein the at least one digital signal processor generates signals representative of the anti-noise to be generated further based at least in part on the signals representative of the secondary path effects associated with at least one of the first or the second ear pieces.

10. The kit of claim 7 wherein the signals representative of noise generated by the noise source are signals representative of snoring and the at least one digital signal processor generates signals representative of the anti-noise to be generated based at least in part on the signals representative of snoring.

11. The kit of claim 8 wherein the circuitry of the control unit employs at least one adaptive filter to generate the signals representative of the anti-noise.

12. The kit of claim 11 wherein the circuitry of the control unit configures at least one adaptive filter based on signals representative of secondary path effect in the ear canal of at least one of the ears.

13. The kit of claim 11 wherein the circuitry of the control unit configures at least one adaptive filter during a run time while active noise cancellation is performed.

14. The kit of claim 7 wherein the circuitry of the control unit provides a defined reference noise signal to at least one in-ear audio transducer of the first or the second ear pieces to produce a defined reference noise, and samples a secondary path effect in the ear canal that results from the defined reference noise.

15. The kit of claim 14 wherein the circuitry of the control unit provides the defined reference noise signal during a training period during which no active noise cancellation is performed.

16. The kit of claim 7 wherein the circuitry of the control unit provides a masking noise signal to at least one in-ear audio transducer of the first or the second ear pieces to produce a masking noise while active noise cancellation is performed.

17. The kit of claim 16 wherein the circuitry of the control unit adjusts sound level of the masking noise in synchronization with a sound level of the noise generated by the noise source.

18. The kit of claim 16 wherein the circuitry of the control unit adjusts sound level of the masking noise in direct correlation with a sound level of the noise generated by the noise source.

19. The kit of claim 1 wherein the control unit is separate and distinct from the first and the second ear pieces, and remotely spaced from the first and the second ear pieces in use.

20. The kit of claim 1 wherein the control unit is an integral part of one of the first or the second ear pieces.

21. The kit of claim 1 wherein the first ear piece further comprises a first housing and the at least one resilient body includes a first resilient body and at least a second resilient body, the second resilient body having a different dimension than the first resilient body, the first and the second resilient bodies interchangeably over at least a portion of the first housing.

22. The kit of claim 1, further comprising:

a set of instructions which includes at least one instruction to locate the noise source audio transducer closer to the source of noise than the user by a defined distance.

23. The kit of claim 22 wherein the defined distance is less than 2-3 feet.

24. A method of attenuation of snoring noise, the method comprising:

receiving a number of noise source signals by circuitry from a noise source audio transducer positioned proximate a source of snoring noise, the noise source signals representative of snoring produced by the source of the snoring noise;

receiving a number of error signals by the circuitry, the error signals representative of at least one discrepancy between the noise and the anti-noise in a first ear canal of a user who is not the noise source, the at least one discrepancy between the noise and the anti-noise detected by at least one in-ear audio transducer that is within a defined distance from a respective tympanic membrane associated with the first ear canal of the user, the defined distance which is equal to or less than one-tenth of a wavelength of at least one frequency in the snoring noise, the at least one frequency which is between 1135 Hz and 2000 Hz;

generating a number of anti-noise drive signals by the circuitry to produce anti-noise, the generation of the anti-noise drive signals based at least in part on the received noise source signals and the received error signals; and providing the anti-noise drive signals by the circuitry to at least one in-ear audio transducer to produce anti-noise in at least one ear canal.

25. An ear piece wearable by a user, the ear piece comprising:

a resilient body, the resilient body sized and dimensioned to resiliently engage an outer portion of an ear canal of an ear of a human user when worn at least partially in the ear canal;

at least one in-ear audio transducer, the at least one in-ear audio transducer spaced to be positioned in an inner portion of the ear canal within a defined distance from a respective tympanic membrane associated with the ear canal when the at least one resilient body resiliently engages the outer portion of the ear canal, the defined distance which is equal to or less than one-tenth of a wavelength of at least one frequency in the snoring noise, the at least one frequency which is between 1135 Hz and 2000 Hz; and at least one radio, the at least one radio communicatively coupled to provide drive signals to drive the at least one in-ear audio transducer to produce anti-noise and to transmit error signals representative of at least one discrepancy between the noise and the anti-noise detected in the ear canal by the at least one in-ear audio transducer.

* * * * *